US005319395A

United States Patent [19]

Larky et al.

[11] Patent Number: 5,319,395

[45] Date of Patent: Jun. 7, 1994

[54] PIXEL DEPTH CONVERTER FOR A COMPUTER VIDEO DISPLAY

[75] Inventors: Steven P. Larky, Austin, Tex.; Alan W. Peevers, Peekskill, N.Y.; Joe C. St. Clair, Round Rock, Tex.

[73] Assignee: International Business Machines Corporation, Armonk, N.Y.

[21] Appl. No.: 54,701

[22] Filed: Apr. 28, 1993

Related U.S. Application Data

[63] Continuation of Ser. No. 971,702, Nov. 4, 1992, abandoned, which is a continuation of Ser. No. 879,523, May 4, 1992, abandoned, which is a continuation of Ser. No. 798,033, Nov. 20, 1991, abandoned, which is a continuation of Ser. No. 524,201, May 16, 1990, abandoned.

[51] Int. Cl.[5] ..... G09G 1/02

[52] U.S. Cl. ..... 345/190; 345/200

[58] Field of Search ..... 340/747, 799, 800, 703, 340/721, 731, 802; 395/164, 165, 166; 345/190, 200, 185

[56] References Cited

U.S. PATENT DOCUMENTS

| | | | |
|---|---|---|---|
| 4,367,533 | 1/1983 | Wiener | 340/731 |
| 4,434,502 | 2/1984 | Arakawa et al. | 340/747 |
| 4,467,443 | 8/1984 | Shima | 364/900 |
| 4,555,775 | 11/1985 | Pike | 340/747 |
| 4,622,545 | 11/1986 | Atkinson | 340/747 |
| 4,667,305 | 5/1987 | Dill et al. | 340/799 |
| 4,679,038 | 7/1987 | Bantz et al. | 340/721 |
| 4,685,070 | 8/1987 | Flinchbaugh | 340/747 |
| 4,689,807 | 8/1987 | Maan . | |
| 4,783,652 | 11/1988 | Lumelsky | 340/747 |
| 4,821,208 | 4/1989 | Ryan et al. | 340/799 |
| 4,823,286 | 4/1989 | Lumelsky et al. | 364/518 |
| 4,893,116 | 1/1990 | Henderson et al. | 340/747 |
| 4,910,687 | 3/1990 | Butler et al. | 340/799 |
| 4,916,654 | 10/1990 | Sherman et al. . | |

OTHER PUBLICATIONS

Texas Instruments "TMS34010 User's Guide", pp. 5-5 through 5-6, 7-1 through 7-10, 12-161 through 12-163 (1986).

*Primary Examiner*—Alvin E. Oberley
*Assistant Examiner*—Steven J. Saras
*Attorney, Agent, or Firm*—Daniel P. Morris

[57] ABSTRACT

A pixel-depth converter for source-pixel data having a source-pixel depth to destination-pixel data having a destination-pixel depth which differs from the source-pixel depth. A packed-pixel-data depacker circuit receives source-pixel data words having a packed-pixel data format from a source-pixel-data memory and transmits the data words depacked-pixel-data-word-component-by-depacked-pixel-data-word-component in accordance with a user selected pixel-depth-conversion scale factor. A pixel-data-conversion-table storage circuit stores selectable depth-altering pixel-data-conversion data in locations having conversion-table read addresses which are associated with values corresponding to the selected pixel-depth-conversion scale factor. The storage circuit includes independently-operable converted-data-read parallel output ports and associated conversion-table read-address input ports. Conversion-lookup addresses may be applied independently in parallel to the plurality of conversion-table storage circuit. Stored conversion data can be read in parallel from the associated converted-data-read output ports. Input ports of multiplexers are connected to corresponding terminal subsets of the depacker circuit which are associated with different pixel-depth-conversion scale factor. A conversion-lookup address output port of each multiplexer is connected to an associated read-address input port of the storage circuit. The multiplexer control-signal input ports are connectable to a bus for receiving a scale-factor-selection signal which specifies the desired pixel-depth-conversion scale factor and corresponding depacked-source-pixel-data portions.

11 Claims, 9 Drawing Sheets

32-BIT REGISTER
154
153
152
151
164
163
162
161
174
173
172
171
184
183
182
181
LR<3>
LR<2>
LR<1>
LR<0>
PI<31:0>
126
128
130
42
16-1
191
192
193
194
131
132
133
134
141
142
143
144
ADRD<3:0>
ADRC<3:0>
ADRB<3:0>
ADRA<3:0>
124

PIXEL DEPTH CONVERTER FOR A COMPUTER VIDEO DISPLAY

This application is a continuation of application Ser. No. 07/971,702, filed 4 Nov., 1992, now abandoned, which in turn was a continuation of application Ser. No. 07/879,523, filed 4 May 1992, now abandoned, which in turn was a continuation of application Ser. No. 07/798,033, filed 20 Nov. 1991, now abandoned, which in turn was a continuation of application Ser. No. 07/524,201, filed 16 May 1990, now abandoned.

DESCRIPTION

1. Technical Field

The invention is in the field of video-display controllers, and more specifically relates to a video-display controller adapted for controlling video displays used to display several "windows" of information at the same time.

2. Background Art

A video-display system for a personal computer, computer workstation, time-shared computer network or other digital computer system incorporating a central processor is used to show characters, graphs, pictorial images, and other visually-perceived information. Conventional video-display systems include a display screen and a video-display controller for controlling the display screen. A video display is ordinarily divided into atomic display units termed "picture elements" or "pixels." In general, pixels can be controlled with regard to their intensity or color by the video-display controller of the video-display system, which in turn typically is controlled by the central processor of the computer system. When every pixel of a display can be independently controlled by the video-display controller, the controller is referred to as an "all-points-addressable," or "APA," controller. Conventional video-display controllers include digital video memory for storing digital representations of the information to be displayed. In the video memory of an APA video controller, the digital representation of the information to be displayed on a full display screen is referred to as a "bitmap." A bitmap includes display pixel data in which each pixel is represented by one or more bits. The display pixel data is organized in the bitmap so that each pixel location on the video display corresponds to a location in the bitmap. An area of the video memory of an APA video controller which stores the bitmap of a display currently being shown on the display screen is called a "video frame buffer."

For a set of pixel data in general, the number of bits per pixel is referred to as the pixel "depth." In a bilevel monochrome video display, either a pixel is "on" or "off." Consequently, a pixel depth of one is sufficient for pixel display data for a bilevel monochrome display. For a color video display, the pixel depth of the display pixel data determines the maximum number of colors that can be displayed on the screen of the video-display system. Similarly, the pixel depth determines the maximum number of levels of intensity that can be displayed on a gray-scale video display.

Typically, a bitmap for displaying a full screen of text of alphanumeric characters is assembled by an APA video-display controller by repeatedly transferring—on a character-by-character basis—copies of the digital representations of the images of the characters making up the text from a character font storage area into a video frame buffer. Each digital representation of the image of an alphanumeric character includes pixel data specifying the state of each pixel in a rectangular block of pixels in the video display. Thus the transfer of a copy of the digital representation of a character image from a character font storage area into the video frame buffer involves copying pixel data which represent an array of pixels forming a filled rectangular block on the video display to locations in the buffer which correspond to the pixel locations of the block on the video display. In general, such a memory-to-memory transfer operation involving pixel data representing pixels forming a filled rectangular block on the video display is called a "bit boundary block transfer," or "bit-blt" transfer for short.

Using bit-blt transfers from character font storage areas corresponding to different character fonts into a video frame buffer of an APA video controller, a bitmap may be assembled in which characters of different sizes and styles exist side-by-side. The capability to perform bit-blt transfers automatically is often included in conventional APA video-display controllers, since such controllers must frequently perform such transfers, particularly with respect to displays of alphanumeric text. In particular, such controllers often incorporate specialized bit-blt transfer hardware such as a microprogrammable microprocessor with microcode for performing bit-blt transfers, which can perform such transfers relatively efficiently. A specialized integrated-circuit microprocessor which is capable of performing bit-blt transfers is commercially available from Texas Instruments Incorporated of Carrolton, Tex. under the trade designation "TMS 34010 Graphics System Processor."

The display screens of modern video-display systems often provide a high display resolution—for example, color video-display systems are widely available with displays composed of a rectangular array of pixels 1024 columns across and 768 rows high. Such a display screen can be divided into several regions, each of which can be the display area for information from a different program in the computer. Such display regions are typically rectangular in shape and conventionally referred to as "windows." In a single typical windowed video display, one window display area could contain text, another window display area a pictorial image, and yet another a multi-colored bar graph.

Since the window display areas of a windowed video display are typically rectangular in shape, bit-blt rectangular block transfers into a video frame buffer can in principle be used to construct a bitmap for a window video display when the source pixel data transferred into the buffer is the same depth as the display pixel data used in the bitmap. For each window display area, a bit-blt transfer can in principle be made from a source memory area containing source pixel data representing the information to be displayed to locations in the video frame buffer corresponding to the intended location of the window display area on the display. It would be desirable to use any specialized bit-bit transfer hardware of an APA video-display controller to assemble bitmaps for windowed video displays to simplify the programming for the assembly of the bitmaps and to speed the assembly process. However, depth incompatibilities between the source pixel data and the display pixel data making up the bitmap frequently preclude the use of bit-blt transfers to assemble bitmaps for windowed video displays.

A computer system operating under an operating-system program with multitasking and windowing capabilities will typically be running several different application programs at once, each of which may be producing information for display in a different window display area of the video display. Different application programs in general encode display information as source pixel data with different characteristics. In particular, one characteristic of source pixel data that generally varies from program to program is the pixel depth of the pixel data. For example, some application programs may require only text displays, and consequently produce display information encoded as pixel data with a one-bit pixel depth for a bilevel monochrome display. Other application programs may require displays in sixteen colors or sixteen shades of gray, and thus produce display information encoded as pixel data with a four-bit pixel depth. Image-based application programs may require video displays with 256 colors and so produce display information encoded as pixel data with an eight-bit depth.

In general, all of the pixel data included in a single bitmap in an APA video controller must have the same depth. While the bit-blt transfer capability of a conventional APA video-display controller may in principle be used for transferring source pixel data from a source memory area into a window portion of a video frame buffer when the source pixel data is of the pixel depth required for the display pixel data of the bitmap, when the pixel depths of the source pixel data and the display pixel data differ, the source-to-bitmap transfer requires a pixel data depth-conversion step to be carried out on a pixel-by-pixel basis. The "TMS 34010 Graphics System Processor" microprocessor identified above permits source pixel data of one-bit on/off depth to be expanded to two-color destination pixel data of 1,2,4,8, or 16 bits for each of the two colors in the course of bit-blt transfer operations. In the case of source-to-bitmap transfers involving source pixel data with a depth of two or more bits, such a pixel data depth-conversion step has heretofore been performed by the central processor of the computer system. Unfortunately, central processors are inefficient at bit-blt transfer operations in general, and are particularly inefficient at converting pixel data of one depth to pixel data of a different depth.

U.S. Pat. No. 4,689,807 to Maan is directed to a graphics system which is capable of operating on pixels represented by differing numbers of bits. In particular, the graphics data processing apparatus is capable of detecting a transparent color code of a selected length. The graphics data processing apparatus employs a pixel size memory register which stores a number equal to the number of bits representing each pixel . A transparency detection logic circuit receives the color codes corresponding to the source image array and is responsive to the pixel size data to detect transparent color codes of the selected length. Based upon the detection or nondetection of transparent color codes, a transparency select logic circuit selects either the destination data or the combined data in accordance with a raster operation selected.

U.S. Pat. No. 4,622,545 to Atkinson is directed to image compression and manipulation in a graphics system where any arbitrarily shaped region may be defined and stored.

U.S. Pat. No. 6,679,038 to Bantz et al. is directed to a band buffer display system which includes an alternative 4 bit-blt copying.

U.S. Pat. No. 4,685,070 to Flinchbaugh sets forth a graphic system in which there are bit-blt usage windows. A three-dimensional representation is provided on a two-dimensional display of a three-dimensional array wherein desired portions may be excavated to reveal the underlying portions.

U.S. Pat. No. 4,555,775 to Pike describes a graphic system which manipulates windows by copying image data using bit-blt.

SUMMARY OF THE INVENTION

We have invented a pixel-depth converter for expansion and contraction of pixel depths which enables pixel-depth conversions to be performed sufficiently rapidly to permit bitmaps for multicolored windowed video displays to be assembled at speeds generally compatible with conventional bit-blt transfer circuits and which avoids problems of the prior art noted above.

A pixel-depth converter of the invention—particularly preferred when expansion of pixel depths is desired—converts source-pixel data having a source-pixel depth to destination-pixel data having a destination-pixel depth which differs from the source-pixel depth by a pixel-depth-conversion scale factor. The source-pixel depth is equal to one of a plurality of pixel depth values including at least the values one, two, and four. The destination-pixel depth is equal to one of a plurality of pixel depth values including at least the values two, four, and eight.

The pixel-depth converter of the invention comprises a packed-pixel-data depacker circuit. The packed-pixel-data depacker circuit has a packed-pixel-data parallel input port, a depacked-pixel-data parallel output port, and a depacker sequencing-control-signal input port. The packed-pixel-data input port is connectable to a source-pixel-data memory for receiving source-pixel data words from the memory. Each source-pixel data word has a packed-pixel data format and is divisible into a plurality of depacked pixel-data word components corresponding to the pixel-depth-conversion scale factor. Each depacked pixel-data word component includes pixel data of the source-pixel depth for a plurality of pixels and is divisible into a plurality of depacked pixel-data-word component subfields. A plurality of groups of terminals of the depacked-pixel-data parallel output port define depacked-word-component output-field subports, each of which corresponds to a pixel-depth-conversion scale factor. The terminals of each depacked-word-component output-field subport are divisible into a plurality of depacked-word-component-output-field-subport terminal subsets, each containing at least one terminal. The depacker circuit is adapted to receive source-pixel data words at the packed-pixel-data parallel input port and, responsive to a depacker sequencing-control signal applied to the depacker sequencing-control-signal input, transmit each data word sequentially depacked-pixel-data-word-component-by-depacked-pixel-data-word-component through a depacked-word-component output-field subport of the depacked-pixel-data output port specified by the depacker-sequencing control signal.

The pixel-depth converter of the invention also includes a pixel-data-conversion-table storage circuit. The pixel-data-conversion-table storage circuit has a conversion-data load input port, a load-data control-signal input port, a plurality of converted-data-read parallel output ports, and a plurality of conversion-table read-address input ports. Each conversion-table read-address input port is associated with a converted-data-read parallel output port. The pixel-data-conversion-table storage circuit is adapted to receive pixel-data-conversion data in the conversion-data load input port and to store the pixel-data conversion data at data-load storage locations specified by a load-data control signal applied to the lead-data control-signal input port. The pixel-data-conversion-table storage circuit is adapted so that converted-pixel data from data-read storage locations specified by a converted-data read address applied to a conversion-table read-address input port can be read from the associated converted-data-read parallel output port. The plurality of converted-data-read parallel output ports and associated conversion-table read-address input ports are operable effectively independently of one another so that depacked-source-pixel-data-portion conversion-lookup addresses may be applied independently in parallel to the plurality of conversion-table read-address input ports of the pixel-data-conversion-table storage circuit and converted-pixel data from the data-read storage locations specified by the addresses can be read effectively in parallel from the associated converted-data-read parallel output ports.

The pixel-depth converter of the invention also comprises a plurality of conversion-table address-selector multiplexers. Each conversion-table address-selector multiplexer has a plurality of conversion-table address-selector-multiplexer depacked-source-pixel-data-portion input ports, a conversion-lookup address output port and an address-selector-multiplexer control-signal input port. Corresponding depacked-source-pixel-data-portion input ports of the conversion-table address-selector multiplexers are associated with a pixel-depth-conversion scale factor. Each of the depacked-source-pixel-data-portion input ports is connected to a corresponding depacked-word-component-output-field-subport terminal subset of the depacked-word-component output-field subport which corresponds to the associated pixel-depth-conversion scale factor. Each of the conversion-lookup address output ports of the conversion-table address-selector multiplexers is connected to an associated conversion-table read-address input port. The address-selector-multiplexer control-signal input ports are connectable to a scale-factor-selection signal bus for receiving a scale-factor-selection signal which specifies the desired pixel-depth-conversion scale factor and corresponding depacked-word-component-output field subport terminal subsets to supply depacked-source-pixel-data-portion conversion-lookup addresses for the desired pixel data conversion.

A preferred packed-pixel-data depacker circuit of the pixel-depth converter of the invention comprises a data-shift multiplexer and a data-return register interconnected in a data shift/feedback arrangement.

The data-shift multiplexer of the preferred packed-pixel data depacker circuit preferably includes a no-shift-primer shift-multiplexer data input port, at least a first and second-shift-increment shift-multiplexer data input port, a shift-multiplexer data output port, and a shift-increment control-signal input port. More preferably, the data-shift multiplexer includes a third-shift-increment shift-multiplexer data input port. Each shift-multiplexer data input port has a plurality of shift-multiplexer input terminals. The shift-multiplexer data output port has a plurality of shift-multiplexer output terminals. The data-shift multiplexer is adapted to cause a selected shift-multiplexer data input port to be connected to the shift-multiplexer data output port in response to a shift-increment control signal applied to the shift-increment control-signal input port.

The data-return register of the preferred packed-pixel-data depacker circuit includes a plurality of return-register cells. Each return-register cell is preferably of a Type-D type and has a return- register data input terminal, a return-register data output terminal, and a return-register-cell clock-signal input terminal. The data-return register preferably has a return-register clock-signal input port connected to the return-register-cell clock-signal input terminals of the return-register cells so that application of a return-register clock signal to the return-register clock-signal input port causes data present at the input terminals of the return-register cells to be loaded into the cells.

Each return-register data input terminal of the data-return register of the preferred packed-pixel-data depacker circuit is connected to a corresponding shift-multiplexer output terminal of the data-shift multiplexer of the depacker circuit. The no-shift-primer shift-multiplexer data input port of the data-shift multiplexer constitutes the packed-pixel-data parallel input port of the preferred packed-pixel-data depacker circuit.

Shift-multiplexer data input terminals of the first-shift-increment input port of the data-shift multiplexer of the preferred packed-pixel-data depacker circuit are connected to return-register output terminals of the data-return register in a first-shift-increment shifted-position fashion, so that in operation when the first-shift-increment shift-multiplexer input port is connected to the shift-multiplexer data output port, at least a portion of a data word appearing at the return-register output terminals appears at the shift-multiplexer data output port shifted by a first shift increment. Shift-multiplexer input terminals of the second-shift-increment data input port are connected to return-register output terminals of the data-return register in a second-shift-increment shifted-position fashion, so that in operation when the second-shift increment shift-multiplexer input port is connected to the shift-multiplexer output port, at least a portion of a data word appearing at the return-register output terminals appears at the shift-multiplexer output port shifted by a second shift increment.

The first shift increment differs from the second shift increment. For example, the first shift increment can be four positions to the right and the second shift increment can be eight positions to tile right. At least a depacked-pixel-data portion of the shift-multiplexer output terminals of the shift-multiplexer data output port are connected to terminals of the depacked-pixel-data parallel output port of the packed-pixel-data depacker circuit.

A preferred pixel-data-conversion-table storage circuit of the pixel-depth converter of the invention includes a plurality of conversion-table registers and a plurality of conversion-table readout multiplexers.

Each conversion-table register of the preferred pixel-data-conversion-table storage circuit has a plurality of register input terminals and a like plurality of register output terminals. Corresponding ones of the register input terminals on the various conversion-table registers are preferably connected in parallel to form a conversion-data load input port of the pixel-data-conversion-table storage circuit. Each such conversion-table register preferably has a conversion-table load-register control-signal input terminal. The conversion-table load-register control-signal input terminals of the preferred conversion-table registers collectively constitute the load-data control-signal input port of the pixel-data-conversion-table storage circuit. The register output terminals of the conversion-table registers are preferably grouped to define a plurality of conversion-table-entry effective-register output-terminal groupings.

Each conversion-table readout multiplexer of the preferred pixel-data-conversion-table storage circuit has a plurality of conversion-table-multiplexer data input ports, a conversion-table-multiplexer data output port, and a conversion-table readout-multiplexer effective-register-select control input port. The conversion-table readout-multiplexer effective-register-select control input port of each preferred conversion-table readout multiplexer constitutes a conversion-table read-address input port of the pixel-data-conversion-table storage circuit. The conversion-table-multiplexer, data output port of each such preferred conversion-table readout multiplexer constitutes a converted-data-read parallel output port of the pixel-depth-conversion-table storage circuit. Corresponding ones of the conversion-table-multiplexer data input ports of the plurality of conversion-table-readout multiplexers are connected in parallel to an associated conversion-table-entry effective-register output-terminal grouping of register output terminals so that conversion-table-readout multiplexers can effectively independently read the pixel-data-conversion data appearing on the effective-register output-terminal grouping of register output terminals of the conversion table registers.

Most preferably, the pixel-data-conversion-table storage circuit includes four 32-bit conversion-table registers and four conversion-table readout multiplexers. Each conversion-table readout multiplexer is most preferably eight-bits wide preferably has sixteen conversion-table-multiplexer data input ports. The total of 128 register output terminals of the four conversion-table registers are most preferably grouped to define sixteen conversion-table-entry effective-register output-terminal groupings of eight register output terminals each.

An alternative preferred pixel-data-conversion-table storage circuit of the pixel-depth converter of the invention includes a plurality of conversion-table random-access-memory ("RAM") circuits. Each such conversion-table random-access-memory circuit has a conversion-table RAM load-data input port, a conversion-table RAM read-data output port and a conversion-table RAM address/control input port. The conversion-table RAM load-data input ports of the conversion-table random-access-memory circuits are preferably connected in parallel to constitute the conversion-data load input port of the pixel-data-conversion-table storage circuit. The conversion, table RAM address/control input port of each conversion-table random-access-memory circuit includes load-data address/control input terminals. The load-data control-signal input terminals of the conversion-table random-access-memory circuits are preferably connected in parallel to constitute the load-data control-signal input port of the pixel-data-conversion-table storage circuit. Each conversion-table RAM read-data output port of the preferred conversion-table random-access-memory circuit constitutes a converted-data-read parallel output port of the pixel-data-conversion-table storage circuit. Each conversion-table RAM address/control input port includes read-data address/control signal input terminals which constitute a converted-data read-address input port of the preferred pixel-data-conversion-table storage circuit. The plurality of conversion-table random-access-memory circuits can be loaded in parallel with identical pixel-data-conversion data essentially simultaneously and can be read individually effectively independently of one another also essentially simultaneously.

A pixel-depth converter of the invention particularily adapted for plane extraction converts source-pixel data having a source-pixel depth to destination-pixel data having a destination-pixel depth which differs from the source-pixel depth by a pixel-depth-conversion scale factor. The source-pixel depth is equal to one of a plurality of pixel depth values including at least the values two, four and eight. The destination-pixel depth is equal to one of a plurality of pixel depth values including at least the values one, two and four.

The pixel-depth converter of the invention for plane extraction comprises a plurality of odd/even line-selector multiplexers connected in a cascaded fashion. Each odd/even line-selector multiplexer is a two-to-one multiplexer having an odd-parity input port, an even-parity input port, a selected-parity output port and a parity-select control-signal input port.

A first-stage odd/even line-selector multiplexer of the pixel-depth converter of the invention for plane extraction is connectable to a source-pixel-data memory by way of a source-pixel data bus for receiving source-pixel data words from the memory. Input terminal of the odd-parity input port of the first-stage odd/even line-selector multiplexer are connected respectively to alternate lines of the source-pixel data bus having odd-parity bit-position indexes. Input terminals of the even-parity input port of the first-stage odd/even line-selector multiplexer are connected respectively to alternate lines of the source-pixel data bus having even-parity bit-position indexes. Input terminals of the odd-parity input port of each succeeding odd/even line-selector multiplexer after the first-stage odd/even line-selector multiplexer are connected respectively to alternate output terminals of the selected-parity output port of the immediately-preceding odd/even line-selector multiplexer having odd-parity bit-position indexes. Input terminals of tile even-parity input port of each succeeding odd/even line selector multiplexer after the first-stage odd/even line-selector multiplexer are connected respectively to alternate output terminals of the selected-parity output port of the immediately-preceding odd/even line-selector multiplexer having even-parity bit-position indexes. The parity-select control-signal input ports of the odd/even line-selector multiplexers constitute a plane-select control-word signal input port of the pixel-depth converter.

The pixel-depth converter of the invention for plane extraction also comprises a plurality of stage-select multiplexers. Each stage-select multiplexer has a plurality of stage-select-multiplexer data input ports a stage-select-multiplexer data output port, and a stage-select control-signal input port. Input terminals of the stage-select-multiplexer data input ports of the stage-select multiplexers are connected respectively to output terminals of selected-parity output ports of the odd/even line-selector multiplexers in a manner such that, in operation, data at the output terminals of a selected-parity output of one of the odd/even line-selector multiplexers specified by a stage-select control signal applied to the stage-select control-signal input ports of the stage-select multiplexers appears at a corresponding number of output terminals of one or more stage-select-multiplexer output ports of the stage-select multiplexers.

A preferred pixel-depth converter of the invention for plane extraction includes an extracted-data-consolidator circuit. A preferred extracted-data-consolidator circuit includes a multistage data-consolidator first-in-first-out device. The data-consolidator first-in-first-out ("FIFO") device preferably has a parallel-load FIFO data input port, a clear-selected-stages control-signal input port, a source-bits-per-pixel control-signal input port, and a plurality of FIFO read-data output ports. Each FIFO read-data output port is connected to a corresponding one of the FIFO stages for reading at least a data-word portion of a data word in the FIFO stage. The preferred extracted-data-consolidator circuit also includes a data-consolidator multiplexer having a plurality of data-consolidation input ports, a consolidated-data output port and a data-consolidation-group-select control-signal input port. Each of the data-consolidation input ports is connected to consolidation output terminals of a data-consolidation grouping of one or more FIFO read-data output ports, in a manner such that, in operation, at least data-word portions of one or more successive data words loaded in the data-consolidator first-in-first-out device specified by a source-bits-per-pixel control signal applied to the data-consolidation group-select control-signal input port of the data-consolidator multiplexer appear in a consolidated format at the consolidated data output of the data-consolidator multiplexer of the extracted-data-consolidator circuit.

Preferably, the pixel-depth converter of the invention includes both a pixel-expand circuit capable of converting source pixel-data words of a shorter depth to destination pixel-data words to a longer depth and a plane-extract circuit capable of extracting selected "planes" of pixel data from source pixel-data words of a longer depth to form destination pixel-data words of a shorter depth.

To optimize conversion speed, a pixel-expand circuit of the invention and a plane-extract circuit of the invention can be connected in parallel. A data multiplexer connected to a graphics controller can be used to route source pixel-data words to either the pixel-expand circuit or the plane-extract circuit depending on whether pixel-depth expansion or pixel-depth contraction is appropriate.

Alternatively, it may be advantageous in certain applications to connect a pixel-expand circuit of the invention in series with a plane-extract circuit of the invention, with the pixel-expand circuit preceding the plane-extract circuit. In such a series arrangement, it is preferable to provide switchable pass-through data paths in parallel with each of the pixel-expand circuit and the plane-extract circuit so that either circuit can be selectively by-passed. Plane extraction—without more—limits the values to which source pixel-data words can be converted to those values which are embedded in the original source words and can thus be extracted. Limitations on the values to which a given source pixel-data word Call be converted can be a disadvantage in certain applications. This limitation of plane extraction can be effectively overcome by preceding a plane extraction operation of the invention with a suitable pixel-depth expansion operation in accordance with the invention. The pixel-depth expansion operation in effect permits user-selectable values to be embedded in the expanded source pixel-data words, which embedded user-selectable values can then be selectably extracted in the subsequent plane extraction operation. In preferred such embodiments, source pixel-data words of a given source pixel depth can be converted to destination pixel-data words of a desired destination pixel depth which is shorter than the source pixel depth by a pixel-depth-conversion scale factor with an arbitrary user-selectable mapping of source pixel-data words to destination. pixel-data words. Although two successive pixel-depth conversion operations are required in such an embodiment, which increases the overall conversion time to a single pixel-depth expansion or plane extraction, the increase in conversion time may be acceptable for many applications.

A single preferred pixel depth converter of the invention can perform pixel depth conversions for a number of different pixel-depth-conversion scale factors. Such a preferred pixel depth converter can be realized as a compact digital circuit relative to its functionality. A circuit embodying the pixel depth converter of the invention is preferably realized as an integrated circuit.

According to preferred embodiments of the present invention, a table look-up mechanism can be utilized in a graphics display system to convert pixel data from a source-area pixel depth to a destination-area pixel depth when performing a bit-blt transfer from a source video-memory area to a destination video-memory area.

A preferred embodiment of the pixel-depth converter of the invention permits a video-display controller to achieve automatic adjustment of pixel depths when performing a bit-blt transfer from a source video-memory area to a destination video-memory area. Preferably, the pixel depth converter includes circuits for both expanding and contracting the pixel depth. When expanding pixel depth, the converter preferably includes a look-up table in which an entry of the proper depth is stored for every source pixel value. When contracting pixel depth using a look-up table in accordance with a preferred embodiment of the invention the look-up table in general has the same value in the table for a number of different source pixels data words, since there are more possible source pixel values than destination pixel values.

Preferred embodiments of the present invention provide a computer graphics system having a bilt-blt controller with a windowing feature which includes a pixel-depth converter for expanding from lower depth pixels to higher depth pixels and for contracting from higher depth pixels to lower depth pixels in a data path used by the bit-blt controller. For every bitmap the bit-blt controller has access to, there is an associated pixel depth in bits per pixel. Whenever a bit-blt transfer occurs between two bitmaps, the depth of the two bitmaps is compared and the source pixel values are converted to match the destination pixel depth.

Pixel expansion is required when a bit-blt transfer occurs with the source pixels having a lower depth than the destination pixels. The pixel-depth-converter preferably includes a pixel-depth-conversion table which contains an entry for every possible source pixel value. For example, for a four bit-per-pixel bitmap, the pixel-depth-conversion table would have sixteen entries. Each entry has as many bits as the destination pixel values. During the bit-blt transfer, each source pixel is used as an offset address value to an entry in the table. The entry so addressed is used as the new destination pixel value. The use of such a pixel-depth-conversion table al lows for an effectively arbitrary mapping of any lower-depth source pixel value to any higher-depth destination pixel value.

For economic reasons, it may be desirable in certain applications to limit the full flexibility of a pixel-depth-conversion table. For example, a source pixel value may be appended to a constant value to "fill it out" to match the destination pixel depth. More elaborate mapping techniques can also be used which generate a new destination pixel value as a function of both a source pixel value and a previous pixel value from the destination location. Such a source-and-previous-destination pixel value mapping technique allows transparency or translucency to be simulated, for example. A further use of such a mapping technique may also be used for antialiasing images, where so-called "min-max algorithms" generate a destination color and intensity as a function of source and previous destination pixel values.

Pixel contraction is required when a bit-blt transfer occurs with the source pixels having a greater depth than the destination pixels. Here too, pixel-depth conversion can be performed via a pixel-depth-conversion look-up table, with the table having one entry per source pixel value and each entry having the same depth as the destination pixel. As in the pixel-expansion case, other implementations than a direct table look-up are possible. For example, a plane of the destination pixels could be extracted from one of the planes of the source pixels. As with pixel expansion, the destination pixel value could be a function of a source pixel value and the previous pixel value from the destination location to allow more elaborate mixings of source and destination pixels.

As windowing display systems become more widespread, means to combine efficiently regions with varying pixel depths is desirable. Making automatic pixel-expansion and pixel-contraction functions available in a display controller during bit-blt transfers according to the present invention can substantially speed up the windowing function and free the central processor for other tasks.

BRIEF DESCRIPTION OF THE DRAWINGS

Preferred embodiments of the present invention are described with reference to the following drawings.

DESCRIPTION OF PREFERRED EMBODIMENTS

Figure 1:
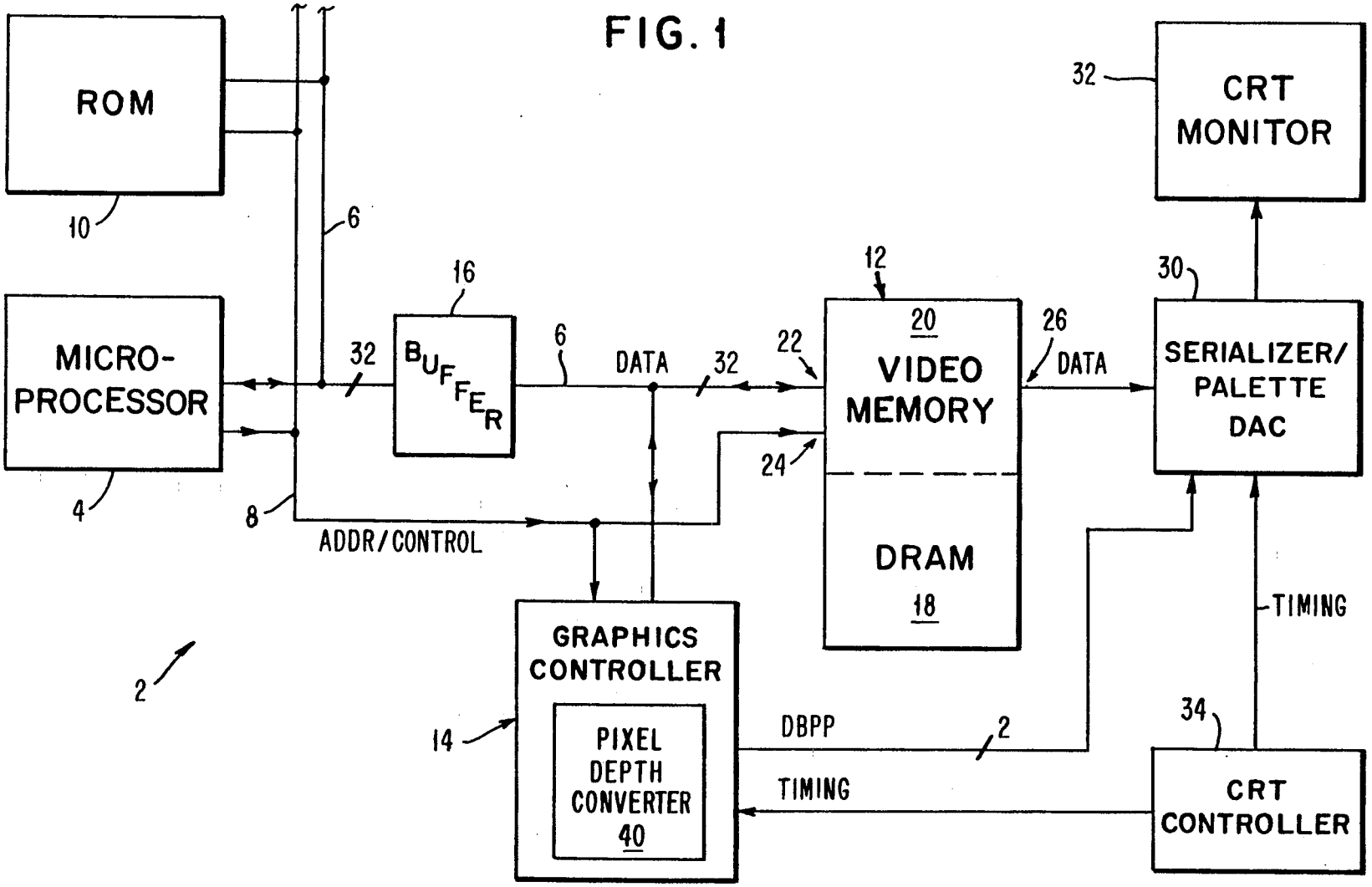
FIG. 1 is a block diagram of a preferred computer work-station of the present invention.

Turning now to FIG. 1, a computer workstation 2 includes a microprocessor 4 connected to a 32-bit-wide data bus 6 and an address/control bus 8. Also connected to the data bus 6 and the address/control bus 8 are a read-only memory 10, a read/write memory 12 and a graphics controller 14. A bi-directional buffer 16 is located in the data bus 6, with the microprocessor 4 and the read-only memory 10 located on one side of the buffer 16 and the read/write memory 12 and the graphics controller 14 located on the other side.

The read/write memory 12 include s dynamic-RAM random-access-memory ("DRAM") main memory 18 and video memory 20. The video memory 20 is a dual-ported video memory accessed through a data read/-write port 22, a read/write address/control port 24, and a video-data read port 26. Data words may be written from the data bus 6 into the video memory 20 through the data read/write port 22 one at a time to randomly-accessed memory locations specified by addresses applied to the read/write address/control port 24 from the address/control bus 8. Data words may be read one at a time through the data read/write port 22 from randomly-accessed memory locations in the video memory 20 specified by addresses applied to the read/write address/control port 24 from the address/control bus 8. Sequences of data words beginning at memory locations specified by initial addresses applied to the read/-write address/control port 24 from the address/control bus 8 may be read automatically from the video memory 20 and transmitted in a serial data-word order through the video-data read port 26 in response to a video-data-read control signal applied to the read/write address/control port 24.

A serializer/palette digital-to-analog converter ("DAC") 30 is connected to a cathode-ray-tube ("CRT") monitor 32, a CRT controller 34 and the graphics controller 14. The CRT controller 34 provides timing signals to the graphics controller 14 and the serializer/palette DAC 30 for controlling the display of images on the CRT monitor 32. The serializer/palette DAC 30 is also connected to the video-data read port 26 of the video memory 20. The serializer/palette DAC 30 receives sequences of data words encoding pixel data of a depth specified by the graphics controller from the video-data read port 26 which are used by the serializer/palette DAC 30 to display images on the CRT monitor 32.

Figure 2:
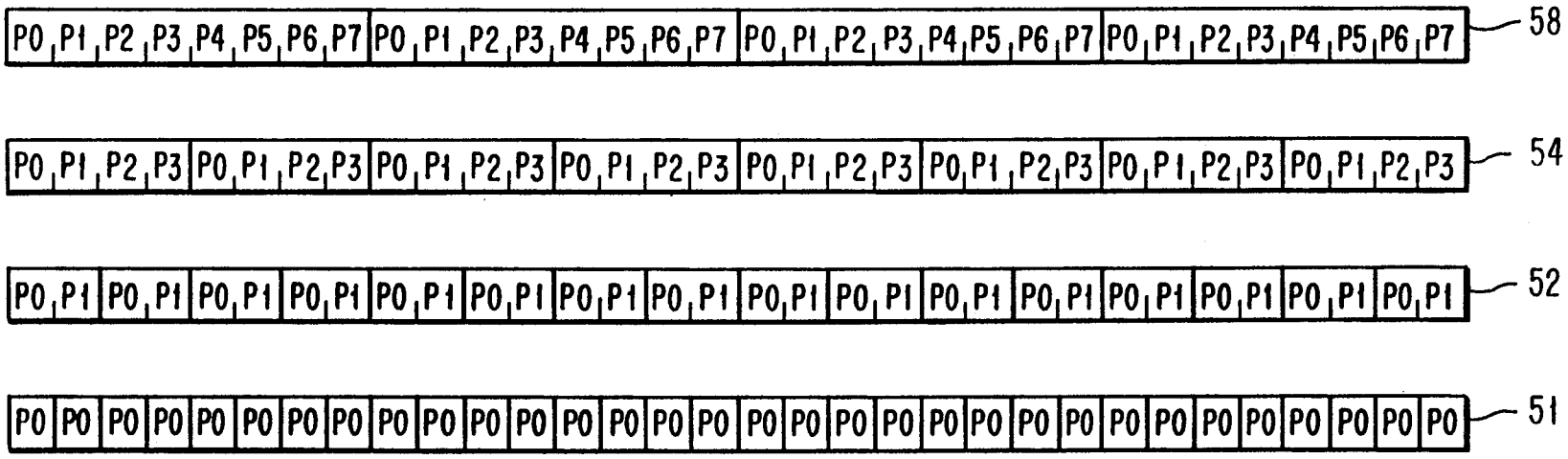
FIG. 2 is a diagram of four 32-bit-wide data words containing pixel data of varying depths.

The graphics controller 14 is capable of performing bit-blt transfers into the video memory 20. The graphics controller 14 includes a pixel-depth converter 40. Different programs running in the computer workstation 2 in general generate pixel data of different depths. More specifically, pixel data may be of one-bit, two-bit, four-bit or eight-bit depth, depending on the program. In FIG. 2, a packed pixel format for pixel data within 32-bit data words is shown. For pixel data of one-bit depth, there are 32 pixel-data fields in the 32-bit data word 51 shown in FIG. 2, with only a single bit position—designated p0—in each of the fields. For pixel data of two-bit depth, there are sixteen pixel-data fields in the data word 52, with each pixel-data field having two bit positions—designated p0 and p1, respectively. The data words 54 and 58 illustrate the packed pixel organization for pixel data of four and eight-bit depth, respectively.

In the drawings and specification of the present case, multibit data words in their entirety are generally denoted A<n:0>, where the positive integer n designates the width of the word less one. Single bits of such a data word are denoted A<i>, where the integer i designates the position of the bit in the word. Contiguous fields within a data word are denoted A<j:k>, where j and k are integers respectively defining the upper and lower inclusive-bit-position boundaries of the field.

Figure 3:
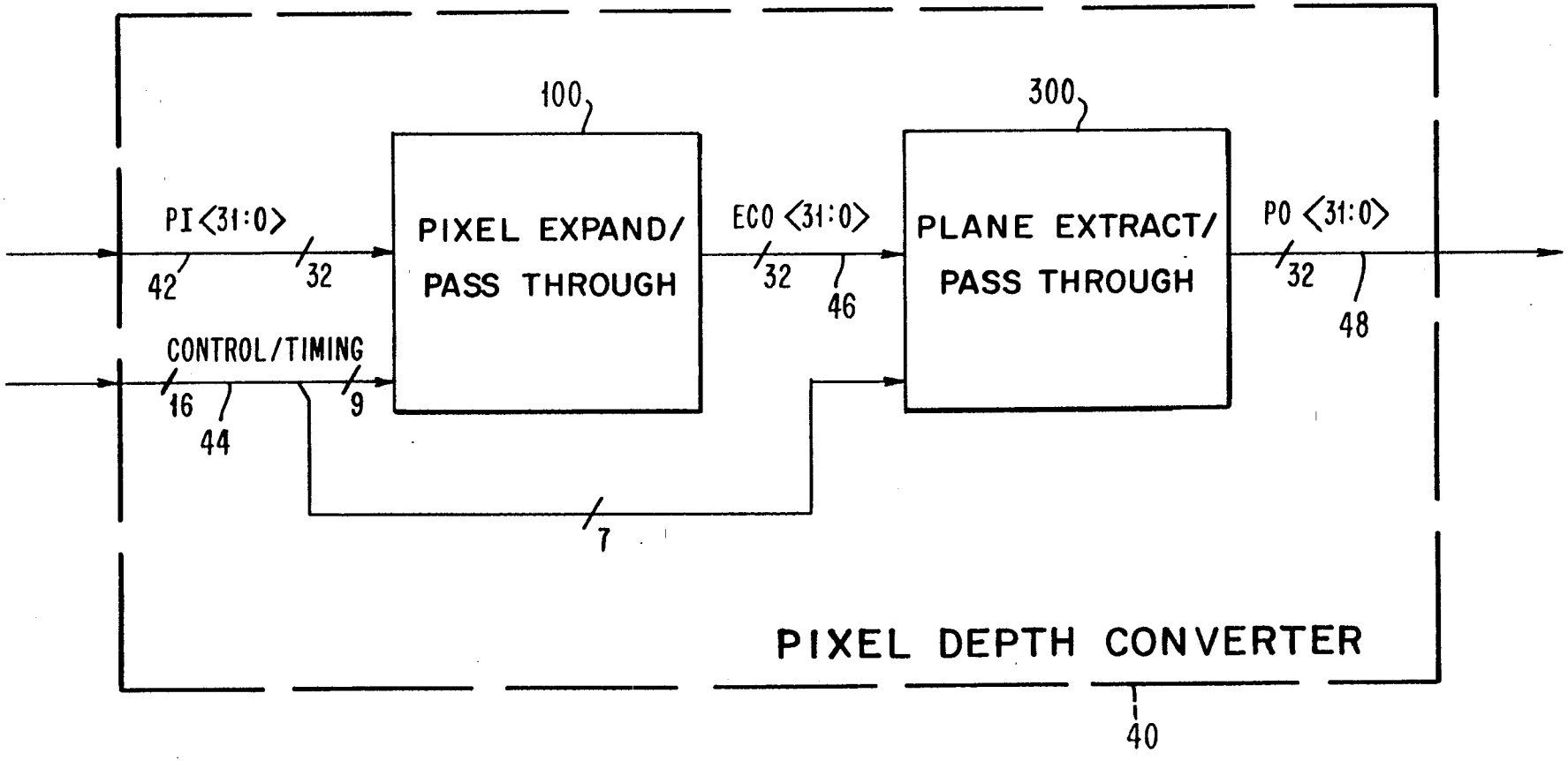
FIG. 3 is a schematic diagram of a preferred pixel depth converter for the computer workstation of FIG. 1.

Turning now to FIG. 3, the pixel depth converter 40 includes a pixel-expand/pass-through circuit 100 and a plane-extract/pass-through circuit 300. The pixel-expand/pass-through circuit 100 receives pixel data from the graphics controller 14 over a 32-bit-wide pixel-data input bus 42. The pixel-data input bus 42 is connected to the 32-bit-wide data bus 6 of the computer workstation 2 by way of a graphics-controller interface circuit (not shown). Control and timing signals for the pixel-expand/pass-through circuit 100 are provided from the graphics controller 14 over a pixel-depth-converter control/timing bus 44.

An expand-circuit pixel-data output bus 46 connects an output of the pixel expand/pass-through circuit 100 to an input of the plane-extract/pass-through circuit 300. The plane-extract/pass-through circuit 300 is also connected to the pixel-depth-converter control/timing bus 44. An output of the plane-extract/pass-through circuit 300 is connected to a depth-converter pixel-data output bus 48. The depth-converter pixel-data output bus 48 is connected to the data bus 6 of the computer workstation 2 by the graphics-controller interface circuit (not shown).

Figure 4:
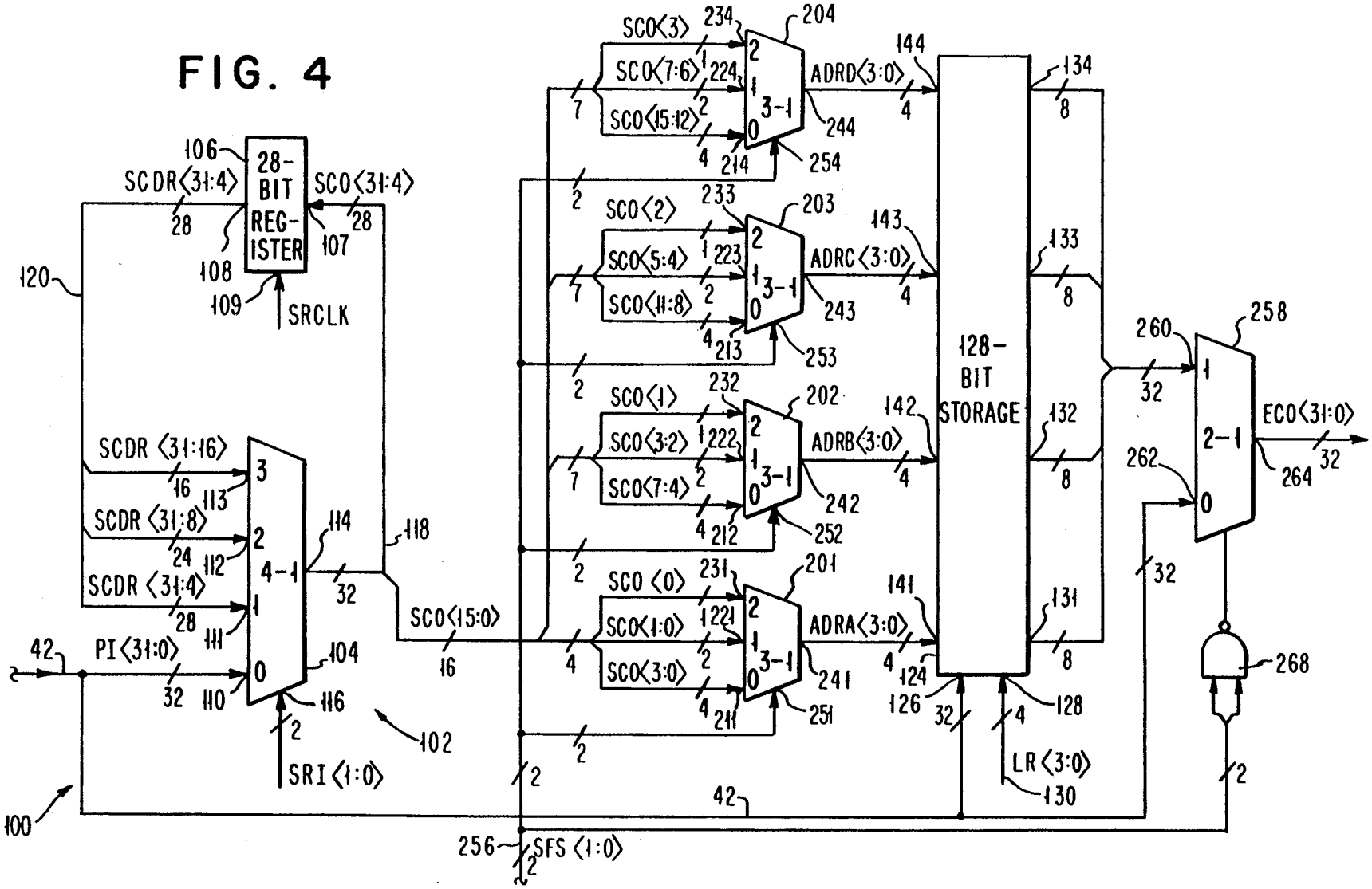
FIG. 4 is a schematic diagram of a pixel-expand/pass-through circuit of the pixel depth converter of FIG. 3.

As shown in FIG. 4, the pixel-expand/pass-through circuit 100 includes a packed-pixel-data depacker circuit 102 which comprises a 32-bit-wide 4-to-1 data-shift multiplexer 104 and a 28-bit data-return register 106.

The data-shift multiplexer 104 has four shift-multiplexer data input ports 110, 111, 112 and 113 and a single shift-multiplexer data output port 114. The data-shift multiplexer 104 also has a two-bit-wide shift-right-increment control-signal input port 116. Application of a two-bit-wide binary-logic signal SRI<1:0> encoding one of the four integers 0 through 3 to the shift-right-increment control-signal input port 116 causes a corresponding one of the four shift-multiplexer input ports 110, 111, 112, 113 of the data-shift multiplexer 104 to be connected to the shift-multiplexer output port 114.

The data-return register 106 has a return-register input port 107 made up of 28 return-register input terminals for loading the 28 cells of the register and a return-register output port 108 made up of 28 return-register output terminals on which the data stored in the cells of the register appear. The data-return register 106 also has a return-register clock input port 109. The data-return register 106 is positive edge triggered, so that application of a clock signal to the return-register clock input port 109 causes data present at the return-register input port 107 at a rising edge of the clock to be loaded into the cells of the register. The cells of the data-return register 106 are of a Type-D type, so that the input terminal of a cell is never transparently connected to the output terminal.

The data-return register 106 and the data-shift multiplexer 104 of the shift-right circuit 102 are interconnected in a data shift/feedback relationship as described below. The shift-multiplexer data output port 114 of the data-shift multiplexer 104 is connected to a 32-bit-wide shift-circuit-output signal path 118. Each of the 32 lines making up the shift-circuit-output signal path 118 corresponds to a bit position of a 32-bit data word SCO<31:0> carried on the signal path 118. The 28 signal lines of the shift-circuit-output signal path 118 which correspond to the 28 highest-order bits of the data word SCO<31:0> i.e., which correspond to the 28-bit data-word field SCO<31:4>—are connected in succession to the 28 return-register input terminals of the return-register input port 107 of the data-return register 106.

The 28 return-register output terminals of the return-register output port 108 of the data-return register 106 are connected to a 28-bit-wide shift-circuit-data-return signal path 120. Each of the lines of the shift-circuit-data-return signal path 120 corresponds to a bit position of a 28-bit shift-circuit data-return data word SCDR<31:4>. Each bit position SCDR<j> of the data word carried on the shift-circuit-data-return signal path 120 corresponds to a bit position SCO<j> of the data-word field SCO<31:4> from the shift-circuit-output signal path 118 stored in the data-return register 106.

Lines of the shift-circuit-data-return signal path 120 are connected to the three highest-order shift-multiplexer data input ports 111, 112, 113 of the data-shift multiplexer 104 as described below. Each of the shift-multiplexer data input ports of the data shift-multiplexer 104 effectively has 32 input terminals. The 28 lines of the shift-circuit-data-return signal path 120 are connected sequentially in a four-positions-to-the-right shifted relationship to the 28 lowest-order input terminals of the second shift-multiplexer data input port 111. In effect, the apparent four remaining highest-order input terminals to the second shift-multiplexer data input port 111 are tied to logic zero. A multiplexer for which certain input terminals are specified to be fixed at particular logic: values can generally be more simply implemented in a straightforward manner as a circuit with the specified fixed effective input states embedded in the circuit than as a full multiplexer circuit with the actual input lines terminals tied to the particular logic values specified.

In the case of the third shift-multiplexer data input port 112, the 24 highest-order lines of the shift-circuit-data-return signal path 120, which carry a 24-bit highest-order data-word field SCDR<31:8>, are connected in turn to the 24 lowest-order input terminals of the data input port 112 in an eight-positions-to-the-right shifted relationship. The apparent eight highest-order input terminals of the third shift-multiplexer input port 112 are in effect tied to logic zero.

In the case of the fourth shift-register input port 113, the sixteen highest-order lines of the shift-circuit-data-return signal path 120, which carry a 16-bit highest-order data-word field SCDR<31:16>, are connected in turn to the lowest-order sixteen input terminals of the fourth data input port 113 in a sixteen-positions-to-the-right shifted relationship. The apparent remaining highest-order sixteen input terminals of the fourth shift-multiplexer input port 113 are in effect tied to logic zero. The data words SCO<31:0> appearing at the shift-multiplexer output port 114 of the data-shift multiplexer 104 as a function of the value encoded by the shift-right-increment control-signal SRI<1:0> is set forth in the second column of Table I below. The pixel-depth-conversion scale factors which correspond to the various values of the shift-right-increments control signal SRI<1:0> are set forth in the third column of Table I. In Table I, '0' denotes a four-bit field of logic zero.

TABLE I

| SRI<1:0> | SCO<31:0> | Scale Factor |
|---|---|---|
| 0 | PI<31:0> | [prime shift circuit] |

TABLE I-continued

| SRI<1:0> | SCO<31:0> | Scale Factor |
|---|---|---|
| 1 | '0' \|\| SCDR<31:4> | 2 |
| 2 | '00' \|\| SCDR<31:8> | 4 |
| 3 | '0000' \|\| SCDR<31:16> | 8. |

Figure 5:
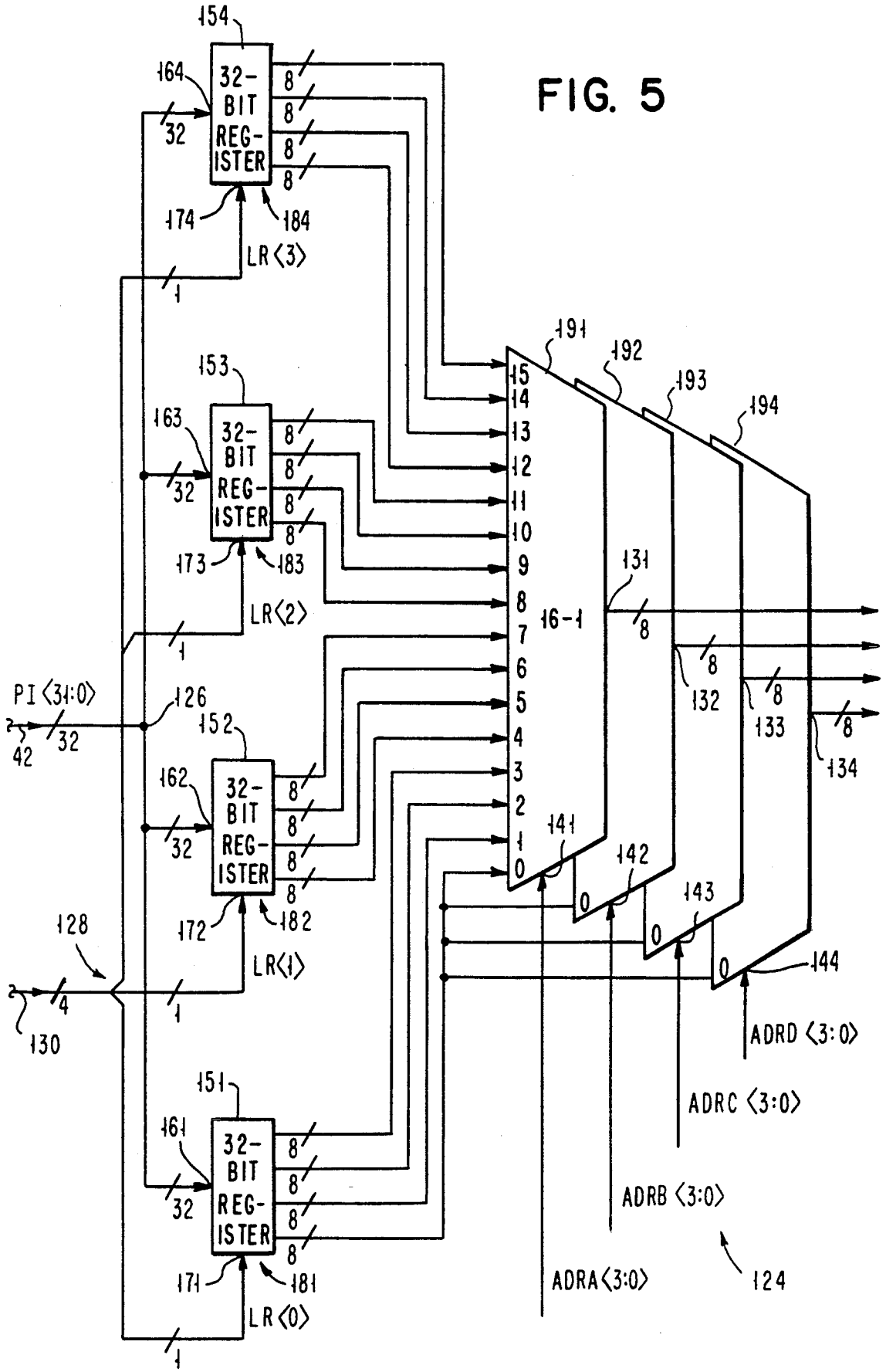
FIG. 5 is a schematic diagram of a 128 bit storage unit for the pixel-expand/pass-through circuit of FIG. 4.

The pixel-expand-pass-through circuit 100 includes a single-input-port, quadruple-output-port pixel-data-conversion-table storage circuit 124. The pixel-data-conversion-table storage circuit 124 includes a 32-bit-wide conversion-table input port 126 and a four-bit-wide load-register control-signal input port 128. The pixel-data-conversion-table storage circuit 124 has four independently-addressable, eight-bit-wide output ports 131, 132, 133, 134. Associated with each of the independently-addressable conversion-table output ports 131-134 is a four-bit-wide conversion-table read-address port 141-144. The pixel-data-conversion-table storage circuit 124 has a storage capacity of 128 bits. As shown in FIG. 5, from the viewpoint of the conversion-table input port 126 and the associated load-register control-signal input port 128, the 128 bits of storage is organized as four 32-bit registers with inputs connected in parallel. From the viewpoint of each of the conversion-table output ports 131-134 and the associated conversion-table read-address port 141-144, the 128 bits of storage is organized as sixteen independently-addressable eight-bit registers.

The pixel-data-conversion-table storage circuit 124 includes four 32-bit conversion-table registers 151-154. Corresponding ones of the input terminals of each of the four conversion-table registers 151-154 are connected in parallel to a corresponding line of the pixel-data input bus 42 of the pixel-expand/pass-through circuit 100. Each of the conversion-table registers 151-154 includes a conversion-table load-register input terminals 171-174. Each of the four conversion-table load-register input terminals 171-174 is connected to a corresponding one of the four lines of a conversion-table load-register control-signal bus 130. The conversion-table load-register control-signal bus 130 constitutes four lines of the control/timing bus 44 of the pixel depth converter 40 and is connected to the graphics controller 14. Each of the four conversion-table registers 151-154 may be selectively loaded with a data word appearing on the pixel-data input bus 42 by application of a control signal to the line of the conversion-table load-register control-signal bus 130 connected to the register.

Each of the four conversion-table registers 151-154 has 32 register output terminals 181-184. The 32 register output terminals of each of the four conversion-table registers 152-154 are grouped as four groupings of eight register output terminals each. Each individual grouping of eight register output terminals may be regarded as in effect the output ports of a single effective eight-bit register. Each of the total of sixteen eight-output groupings—in other words, each of the sixteen effective eight-bit registers—is assigned a unique address from 0 to 15.

The pixel-data-conversion-table storage unit 124 includes four eight-bit-wide 16-to-1 conversion-table readout multiplexers 191-194. Each conversion-table readout multiplexer 191-194 has sixteen eight-bit-wide data input ports which are connected in turn to the sixteen groupings of eight register output ports of the conversion-table registers 151-154. Each of the conversion-table readout multiplexers 191-194 has a conversion-table-multiplexer output port which constitutes a corresponding one of the eight-bit-wide conversion-table-readout ports 131-134 of the storage unit 124. Each of the conversion-table-readout multiplexers 191-194 includes a four-bit-wide conversion-table read-out-multiplexer channel-select control input port which constitutes a corresponding one of the conversion-table read-address ports 141-144 of the storage unit 124. Corresponding ones of the data input ports of the conversion-table-readout multiplexers 191-194 are connected in parallel to the associated grouping of eight register output terminal s of the four conversion-table registers 151-154, as shown in FIG. 5 with respect to the lowest-order input port designated O for the four conversion-table-readout multiplexers. The parallel connections to the remaining data input ports is not shown in FIG. 5 for simplicity of illustration. The parallel connection of corresponding data input ports permits the same grouping of eight register output terminals to be read out of more than one of the conversion-table readout multiplexers 191-194 simultaneously. Thus, the sixteen effective eight-bit registers—in other words, the sixteen eight-output groupings of the four conversion-table registers 151-154—are independently readable by way of the four conversion-table-readout multiplexers 191-194.

Turning again to FIG. 4, the pixel-expand/pass-through circuit 100 includes four conversion-table address-selector multiplexers 201-204. Each of the address-selector multiplexers 201-204 is a four-bit-wide, 3-to-1 multiplexer having three address-selector-multiplexer data input ports 211, 221, 231; 212, 222, 232; 213, 223, 233; 214, 224, 234 and a single address-selector-multiplexer output port 241-244. Each of the conversion-table address-selector-multiplexers 201-204 includes a two-bit-wide address-selection-multiplexer channel-selector control input port 251-254 which is connected to a scale-factor-selection control-signal bus 256. The scale-factor-selection control-signal bus 256 constitutes two lines of the control/timing bus 44 of the pixel depth converter 40 and is connected to the graphics controller 14.

Application of a two-bit-wide scale-factor-selection control signal SFS<1:0> from the scale-factor-selection control-signal bus 256 to the channel-selector control input port 251-254 causes a corresponding one of the data input ports of the address-selector multiplexer 201-204 to be connected to the output port 241-244. Each of the address-selector multiplexer output ports 241-244 is connected to a corresponding one of the conversion-table read-address ports 141-144 of the pixel-data-conversion-table storage unit 124.

Each of the data input ports of the conversion-table address-selector multiplexers 251-254 has in effect four data input terminals. All or various lower-order ones of the data-input terminals of the data input ports of the conversion-table address-selector multiplexers are connected to various ones of the sixteen lowest-order lines of the shift-circuit-output signal path 118 as set forth in Table II below and as indicated in FIG. 4. In Table II and in FIG. 4, the various lines of the shift-circuit-output signal path 118 are identified by the bit positions of the shift-circuit-output data word SCO<31:0> carried by the lines of the signal path. In Table II, the correspondence between the pixel-depth-conversion scale factors and the address-selector multiplexer data input ports is given in the first two columns.

TABLE II

| Scale Factor | Input Port | Address-Selector Multiplexer Inputs A(201) | B(202) | C(203) | D(204) |
|---|---|---|---|---|---|
| 2 | 0 | SCO<3:0> | SCO<7:4> | SCO<11:8> | SCO<15:12> |
| 4 | 1 | SCO<1:0> | SCO<3:2> | SCO<5:4> | SCO<7:6> |
| 8 | 2 | SCO<0> | SCO<1> | SCO<2> | SCO<3>. |

From Table II above and from FIG. 4, it may be seen that for each of the conversion-table address-selector multiplexers 251–254, a total of seven data-input terminals are connected to lines of the shift-circuit-output signal path 118. For the four address-selector multiplexers 251–254, a total of twenty-eight data-input terminals are connected to various ones of the sixteen lowest-order lines SCO<15:0> of the shift-circuit-output signal path 118. From the viewpoint of the four conversion-table address-selector multiplexers 251–254, the twenty-eight connections by data input terminals to the sixteen lowest-order lines SCO<15:0> of the shift-circuit-output signal path 118 define the data output terminals of a depacked-pixel-data parallel output port of the packed-pixel-data depacker circuit 102. Specifically, the data output terminals of the depacked-pixel-data parallel output port of the packed-pixel-data depacker circuit 102 are identified by the twenty-eight bit positions SCO<j> set forth in Table II.

The data-output terminals of the depacked-pixel-data parallel output port may be grouped in accordance with the rows of Table II above to define three depacked-word-component output-field subports corresponding respectively to the three pixel-depth-conversion scale factors. Specifically, the depacked-word-component output field subports identified by SCO<15:0>, SCO<7:0>, and SCO<3:0> correspond respectively to the scale factors 2, 4, and 8. The data output terminals of each of the three depacked-word-component output field subports can be divided into four depacked-word-component-output-field-subport terminal subsets, with each terminal subset being connected to a single data input port of one of the four conversion-table address-selector multiplexers 251–254. Thus the depacked-word-component output field subport SCO<15:0> is divided into the four depacked-word-component-output-field-subport terminal subsets SCO<3:0>, SCO<7:4>, SCO<11:8>, and SCO<15:12>, as shown in the first row of Table II. Each of the remaining two depacked-word-component output field subports SCO<7:0> and SCO<3:0> is divided into the four depacked-word-component-output-field-subport terminal subsets specified respectively by the corresponding second and third rows of Table II.

Each data-input terminal of the data-input ports of the conversion-table address-selector multiplexers 251–254 which is not connected to a line of the shift-circuit-output signal path 118 is in effect tied to logic zero. Thus, for example, the address-selector-multiplexer output port 241 of the first address-selector multiplexer 201 carries the four-bit address '000' || SCO<0> when the scale-factor-selection control-signal bus 256 carries a binary-logic control signal specifying the data-input port 2.

The pixel-expand/pass-through circuit 100 includes a pixel-expand/pass-through multiplexer 258. The pixel-expand/pass-through multiplexer 258 is a 32-bit-wide 2-to-1 multiplexer having a pixel-expand data input 260 and a pass-through data input 262. The four eight-bit-wide conversion-table output ports 131–134 are connected in a concatenated fashion to the 32-bit-wide pixel-expand data input port 260 of the pixel-expand-/pass-through multiplexer 258. The pixel-data input bus 42 is connected to the pass-through data input port 262 of the pixel-expand/pass-through multiplexer 258. A 32-bit-wide pixel-expand/pass-through data output port 264 of the pixel-expand/pass-through multiplexer 258 is connected to the expand-circuit pixel-data output bus 46 of the pixel-expand/pass-through circuit 100. The expand-circuit pixel-data output bus 46 carries an expand-circuit output data word ECO<31:0> transmitted from the pixel-expand/pass-through data-output port 264 of the pixel-expand/pass-through multiplexer 258.

The pixel-expand/pass-through multiplexer 258 includes a pixel-expand/pass-through selection control signal-input 266. Application of a binary pixel-expand pass-through control signal to the pixel-expand/pass-through control-signal input 266 causes one or the other of the pixel-expand data input 260 or the pass-through data input 262 of the pixel-expand/pass-through multiplexer 258 to be connected to the pixel-expand/pass-through multiplexer output 264. The pixel-expand/pass-through control-signal input 266 is connected to an output of a pixel-expand-bypass NAND gate 268. The pixel-expand-bypass NAND gate 268 has two logic inputs which are connected to the two lines of the scale-factor-selection control-signal bus 256. The pixel-expand/pass-through multiplexer 258 in conjunction with the pixel-expand-bypass NAND gate 268 causes the pixel-input data bus 42 to be connected to the expand-circuit pixel-data output bus 46 when the two-bit-wide scale-factor-selection control-signal bus 256 carries the binary logic signal "11." For all other binary logic signals carried on the scale-factor-selection control-signal bus 256, the pixel-expand/pass-through multiplexer 258 and the pixel-expand-bypass NAND gate 268 causes the four concatenated conversion-table output ports 131–134 of the pixel-data-conversion-table storage circuit 124 to be connected to the expand-circuit pixel-data output bus 46.

Figure 6:
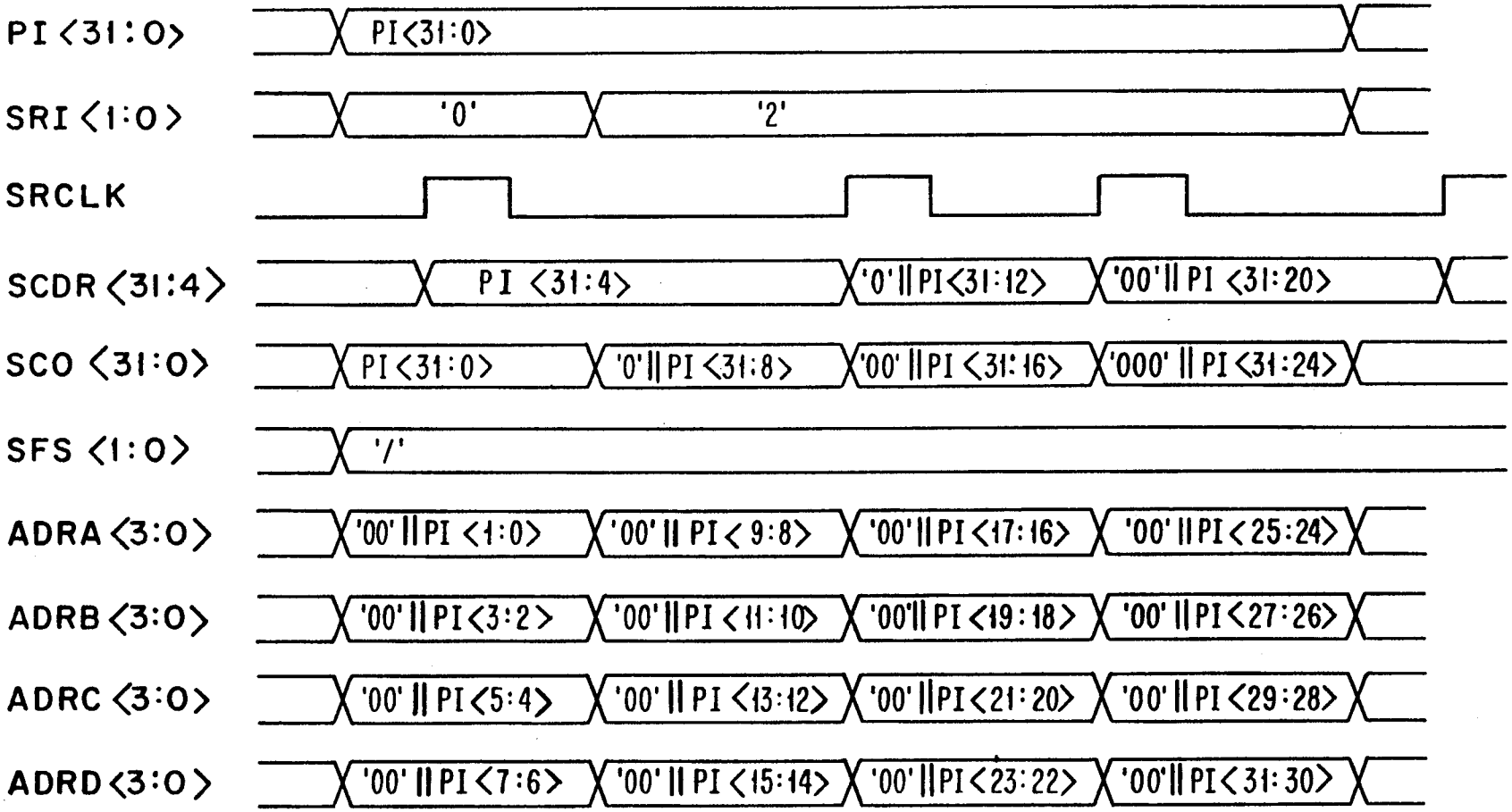
FIG. 6 is a timing diagram for the pixel-expand/pass-through circuit of FIG. 4.

FIG. 6 provides a timing diagram for the operation of the pixel-expand/pass-through circuit 100 for an illustrative example of expansion of source pixel data in a single source-pixel-data word. In the example of FIG. 6, the source pixel data has a source-pixel depth of two and the destination pixel data has a destination pixel depth of eight so that the pixel depth expansion factor is four.

A 32-bit source-pixel data word PI<31:0> of 16 two-bit pixel-data fields is applied by way of the pixel-data input bus 42 to the lowest-order: shift-multiplexer input port 110 of the data-shift multiplexer 104 over the time interval indicated in the first line of the timing diagram of FIG. 6. The source-pixel-data word PI<31:0> has the packed pixel format shown for the pixel data word 52 for pixel data of two-bit pixel depth shown in FIG. 2.

A two-bit-wide shirt-right-increment control signal SRI<1:0> applied to the shift-right-increment control-signal input port 116 of the data-shift-multiplexer 104 encodes the value "0" during the first time interval shown in the second line of the timing diagram of FIG. 6 to initialize or "prime" the packed-pixel-data depacker circuit. Consequently, during the first time interval, the source-pixel-data data word PI<31:0> appears at the shift-multiplexer output port 114 of the data-shift-multiplexer 104 and constitutes the shift-circuit-output data word SCO<31:0>, as shown in the fifth line of the timing diagram of FIG. 6.

As shown in the sixth line of the timing diagram of FIG. 6, the two-bit-wide scale-factor-selection control signal SFS<1:0> encodes the value "1" throughout the depth-conversion process for this example, which corresponds to a pixel-depth-conversion scale factor of four. The scale-factor-selection control signal SFS<1:0> of "1" is applied in parallel to the channel-selector control input ports 251–254 of the four conversion-table address-selector multiplexers 201–204, so that the second address-selector-multiplexer data input ports 221–224 of the multiplexers are connected to the corresponding address-selector-multiplexer output ports 241–244. From Table II above, sets forth the bit positions of the shift-circuit-output data word SCO<31:0> which are applied to the second address-selector-multiplexer data input ports 221–224 of the four address-selector multiplexers. Specifically, the lower-order eight-bit field SCO<7:0> of the shift-circuit-output data word is divided into four pairs of two-adjacent-bit fields which define four two-bit-wide address fields SCO<1:0>, SCO<3:2>, SCO<5:4> and SCO<7:6>. Each of the two-bit-wide address fields is applied to the second address-selector-multiplexer data input ports of address-selector inputs as shown in FIG. 4. The two-bit-wide address fields appear at the address-selector-multiplexer output ports 241–244 with two zeros concatenated to the leading positions to form four-bit-wide conversion-lookup data-read addresses ADRA<3:0>, ADRO<3:0>, ADRC<3:0> and ADRD<3:0> for the pixel-data-conversion-table storage unit 124. In the example under consideration, the resulting four conversion-lookup addresses during the initial time interval defined in the second line of the timing diagram of FIG. 6 are set forth in the corresponding initial time intervals of lines 7 through 10 of the timing diagram.

Because of the two leading zeros in the conversion-lookup addresses, only the four lower effective eight-bit registers of the pixel-depth-conversion-table storage circuit 124 are accessed in the example under discussion. Each zero-extended address specifies one eight-bit destination-pixel data value stored in the storage circuit.

As shown on the third line of the timing diagram of FIG. 6, three clock pulses SRCLK are applied to the return-register clock input port 109 of the data-return register 106 during the depth conversion cycle. The first pulse causes the 28 higher-order bits PI<31:4> of the source-pixel-data data word PI<31:0> to be loaded into the data-return register 106, to appear as the shift-circuit-data-return data word SCDR<31:4> as shown the fourth line of the timing diagram of FIG. 6.

A transition of the shift-right-increment control signal SRI<1:0> from "0" to "2" shown in the second line of the timing diagram of FIG. 6 causes the shift-multiplexer output port 114 of the data-shift multiplexel 104 to switch from being connected to the first shift-multiplexer input port 110 to being connected to the third shift-multiplexer input port 112. As a result, the 24-bit high-order data field SCDR<31:8> from the 28-bit-shift-circuit-data-return data word SCDR<31:4> from the data return register 106 appears at the 32-bit shift-multiplexer output port 114 in the lowest 24 bit positions. The eight high-order positions are filled with zeros. As a result, after the transition of the shift-right-increment control signal SRI<1:0> from "0" to "2," the shift-circuit output data word SCO<31:0> at the shift-multiplexer output port 114 of the data shift multiplexer 104 switches to the data word "0" || PI<31:8>, as shown in the fifth line of the timing diagram of FIG. 6. The four conversion table addresses correspondingly switch to the zero-extended two-bit-wide address field values shown in the second interval in the seventh through the tenth lines 7 through 10 of the timing diagram of FIG. 6.

The second and third clock pulses SRCLK shown in the third line of the timing diagram of the timing diagram of FIG. 6 in turn cause the shift-circuit-data-return data word SCDR<31:4> to be shifted successively to the right by eight positions with the eight high-order bit positions filled with zeros, as shown in the fourth line of the timing diagram. The shift-circuit output data word SCO<31:0> is correspondingly shifted to the right eight bit positions—with the eight high-order bit positions filled with zeros—upon each of the second and third clock pulses, as shown in the fifth line of the timing diagram of FIG. 6. The four addresses change as shown in the third and fourth time intervals of the seventh through the tenth lines of the timing diagram.

At the end of the cycle shown in the timing diagram of FIG. 6, each of the sixteen two-bit-wide source-pixel data fields in the source-pixel data word PI<31:0> will have been converted to a zero-extended four-bit conversion-lookup data-read address and applied to one of the four conversion-table read address input ports 141–144 of the pixel-data-conversion-table storage circuit 124 to cause a corresponding eight-bit destination pixel-data value to be read from the storage circuit. Eight-bit destination pixel-data values are combined in parallel, four-at-a-time in a concatenated fashion to form 32-bit destination-pixel-data words. Since the source pixel depth is expanded by a pixel-depth conversion scale factor of four, the original 32-bit source-pixel data word PI<31:0> is converted into four 32-bit destination-pixel data words.

Now for a second example, consider a case in which a source pixel data of a four-bit depth are expanded to destination-pixel data of an eight-bit depth. Expansion from a four-bit depth to an eight-bit depth gives rise to an expansion factor of 8/4 or 2. Two pixel-depth conversion cycles are required—a first cycle to expand the four four-bit pixel data values in a lower half PI<15:0> of the source-pixel data word and a second cycle to expand the four pixel data values in the upper half of the source pixel data word PI<31:16>. The second cycle expands the source pixel data contained in bits PI<31:16> after they have been placed on SCO<15:0> by the action of the shift right circuit 102.

From the row in Table II corresponding to an expansion factor of two, it can be seen that the first conversion-lookup data-read address ADDRA<3:0> is set to SCO<3:0>, the second data-read address ADDRB<3:0> is set to SCO<7:4>, the third data-read address ADDRC<3:0> is set to SCO<11:8>, and the fourth data-read address ADDRD<3:0> is set to SCO<15:12>. Each of the four-bit conversion-lookup data-read addresses represents one of the incoming four-bit source pixel data values, one-for-one. The four data-read addresses in each pixel-depth conversion cycle select it independently in parallel corresponding ones of sixteen eight-bit values previously stored in the pixel-data-conversion-table storage circuit 124. The four eighth-bit values represent four destination pixels of eight-bit depth. The four destination pixel values concatenated to form a single 32-bit word which can then be written into the destination bitmap in the video memory by the graphics controller on the 32-bit wide data bus 6.

Figure 7:
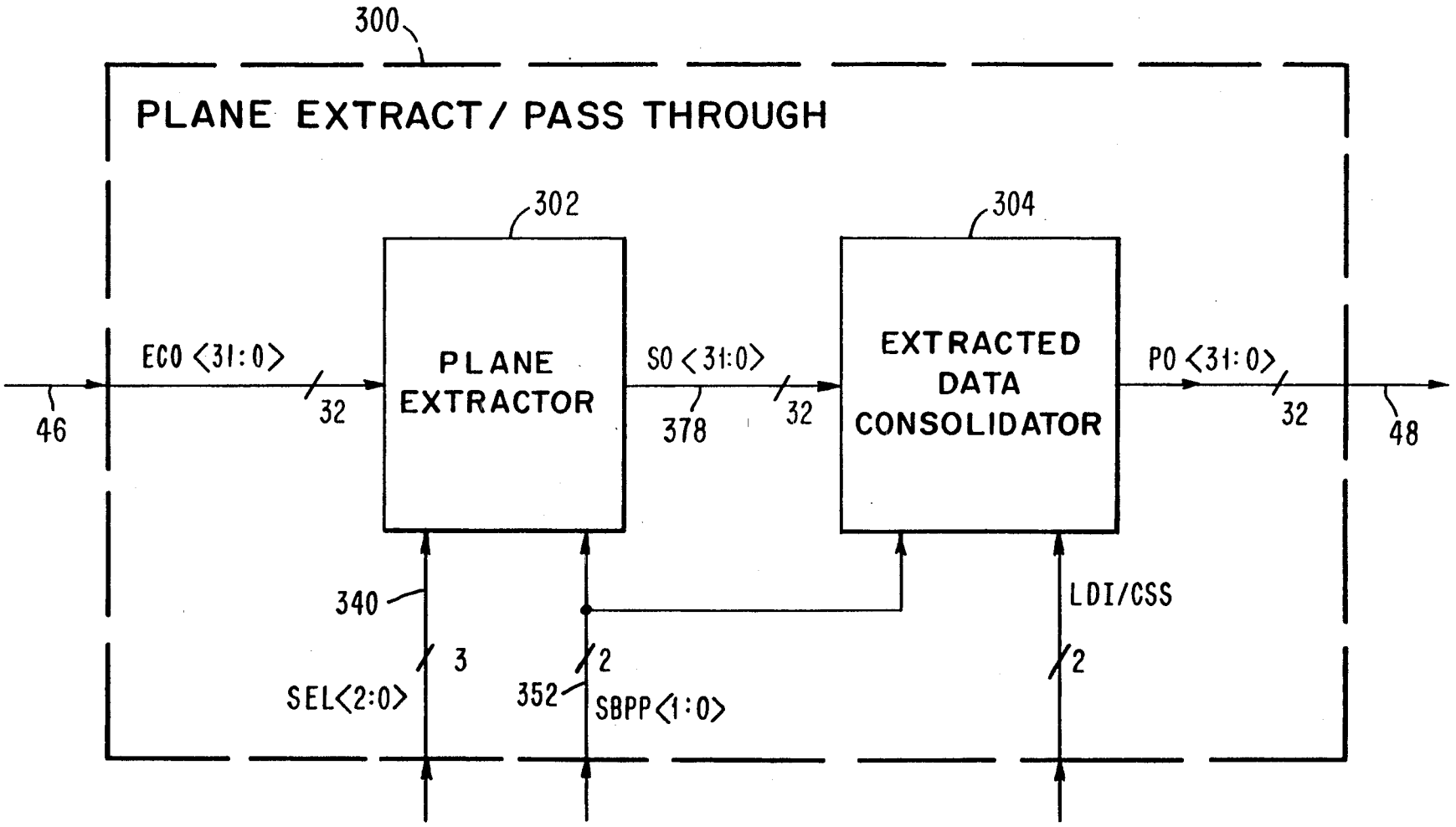
FIG. 7 is a schematic diagram of a plane-extract/pass-through circuit of the pixel depth converter of FIG. 3.

As a third example, consider a case in which two-bit pixels are expanded to four-bit pixels. The expansion factor is again two as in the preceding example, so the address bit selection is identical. However, the data stored in the register locations of the pixel-data-conversion-table storage circuit 124 is now interpreted differently. In this example, each eight-bit pixel-data-conversion data entry constitutes two separate four-bit pixel-data values which have been concatenated. The four-bit conversion-lookup data-read addresses represent two two-bit pixel-data values concatenated. The upper two bits of each conversion-lookup data-read address can be thought of as accessing the upper four bits of the effective eight-bit registers, while the lower two bits of the data-read address access the lower four bits of the effective registers. In general with proper loading of pixel-data-conversion data into the pixel-data-conversion-storage circuit, preferred embodiments of the invention allow the same address select function to work for all cases in which the expansion factor is the same. In the present example, referring to Table II, the upper nibble of the pixel-data-conversion-table entries must correspond to the upper two data-read address bits, while the lower nibble must correspond to the lower two data-read address bits. For example, if it is desired to map the two-bit code "00" to the four-bit code "000" and the two-bit code "11" to the four-bit code "1110," the pixel-data-conversion table must be loaded in such a way that all data-read addresses "00XX" (where "X" represents "don't care") contain an upper nibble of "0001," while all addresses "11XX" contain an upper nibble of "1110". A similar process allows the values for the lower nibble of the file entries to be determined. As in the preceding examples since the expansion factor is two, two pixel-depth conversion cycles are required for each 32-bit source-pixel data word;

Turning now to FIG. 7, the plane-extract/pass-through circuit 300 includes a plane extractor 302, for extracting a plane of pixel data from the data on the expand-circuit pixel-data output bus 46, and an extracted data consolidator 304, for consolidating the pixel data extracted by the plane extractor 302.

Figure 8:
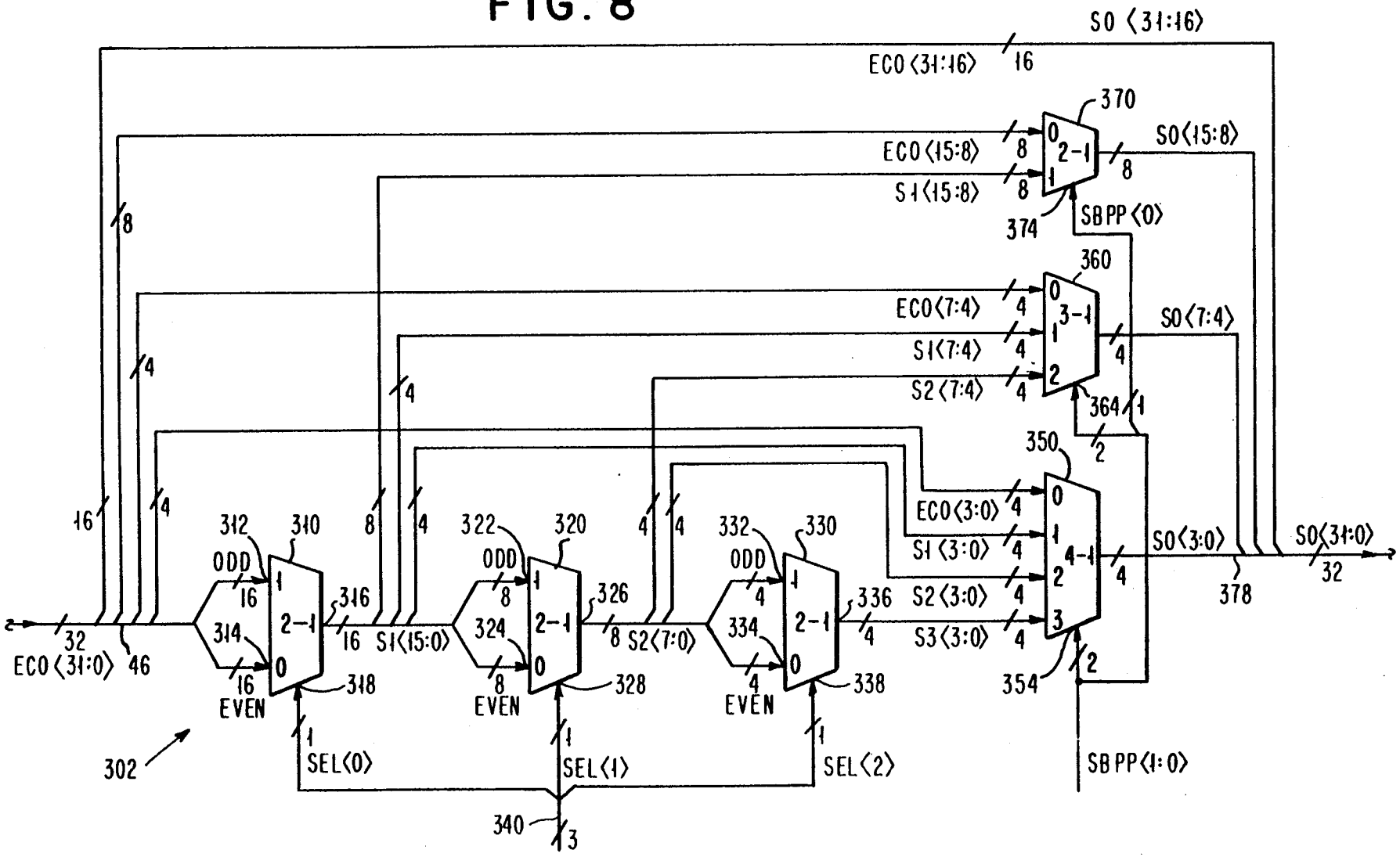
FIG. 8 is a schematic diagram of a plane-extractor circuit of the plane-extract/pass-through circuit of FIG. 7.

As shown in FIG. 8, the plane extractor 302 includes three odd/even line-selector multiplexers 310, 320, 330 connected in a cascaded fashion. The three odd/even line-selector multiplexers 310, 320, 330 are conveniently referred to in terms of the stage of the cascade which they constitute. Thus, the first odd/even line-selector multiplexer 310 in the cascade is referred to as the first-stage odd/even line-selector multiplexer 310; the second line-selector multiplexer 320 in the cascade as the second-stage odd/even line-selector multiplexer 320; and the third line-selector multiplexer 330 in the cascade as the third-stage odd/even line-selector multiplexer 330. Each of the three odd/even line-selector multiplexers 310, 320, 330 is a two-to-one multiplexer having an odd-parity input port 312, 322, 332 and an even-parity input port 314, 324, 334. Each of the three line-selector multiplexers 310, 320, 330 also has a selected-parity output port 316, 326, 336 and a parity-select control-signal input port 318, 328, 338. The selected-parity output port 316, 326, 336 of each line-selector multiplexer 310, 320, 330 is connectable to either the odd-parity input port 312, 322, 332 or the even-parity input port 314, 324, 334 depending on the state of a parity-select control-signal SEL<i> applied to the parity-select control-signal input port 318, 328, 338 of the multiplexer.

The first stage odd/even line-select multiplexer 310 is a 16-bit-wide multiplexer. The sixteen terminals of the odd-parity input port 312 of the first-stage line-selector multiplexer 310 are connected to the alternate lines of the expand-circuit pixel-data output bus 46 which carry logic signals ECO<i> for which the index "i" is odd. The remaining sixteen terminals of the expand-circuit pixel-data output bus 46—which carry logic signals ECO<i> for which the index "i" is even—are connected to the sixteen lines of the even-parity input port 314 of the first stage odd/even line-selector multiplexer 310. The parity-select control-signal input port 318 of the first-stage line-selector multiplexer 310 receives the parity select control signal SEL<0>. The sixteen output terminals of the selected-parity output port 316 of the first-stage odd/even line-selector multiplexer 310 carry a sixteen-bit-wide first-stage parity-select output dater word designated S1<15:0>.

The sixteen output lines from the selected-parity output port 316 of the first-stage odd/even line-selector multiplexer 310 are connected to the input ports 322, 324 of the second-stage odd/even line-selector multiplexer 320 as follows. Alternate lines of the sixteen lines bearing the odd-parity bit positions of the first-stage parity-select output data word S1<15:0> are connected to the eight input terminals of the odd-parity input port 322 of the second-stage odd/even line-selector data multiplexer 320. The remaining eight lines which carry the even-parity bit positions of the first-stage parity-select output data word S1<15:0> are connected to the eight input terminals of the even-parity input port 324 of the second-stage odd/even line-selector multiplexer 320. The parity-select control-signal input port 328 of the second-stage line-selector data multiplexer 320 receives the parity-select control signal SEL<1>. The eight output terminals of the selected-parity output port 326 of the second-stage line-selector multiplexer 320 carry a second-stage parity-select output data word designated S2<7:0>.

Eight output lines from the selected-parity output port 326 of the second-stage odd/even line-selector multiplexer 320 are connected to the input ports 332, 334 of the third-stage odd/even line-selector multiplexer 330 in a manner analogous to that described in the preceding paragraph for connecting the selected-parity output port 316 of the first stage line-selector multiplexer 310 to the odd and even-parity input ports of the second-stage line-selector multiplexer 320. Specifically, the four lines of the eight output lines carrying odd parity bit positions of the second-stage parity-select output data word S2<7:0> are connected to the four-bit-wide odd-parity input port 332 of the third-stage odd/even line-selector multiplexer 330. The remaining four lines, which carry the even-parity bit positions of the second-stage parity-select output data word S2<7:0>, are connected to the four input terminals of the even-parity input port 334 of the third-stage line-selector data multiplexer 330. The parity-select control signal SEL<2> is applied to the parity-select control-signal input port 338 of the third-stage line-selector data multiplexer 330. The four output terminal of the selected-parity output port 330 of the third-stage odd/even line-selector multiplexer 330 carries a four-bit third-stage parity-select output data word designated S3<3:0>.

A plane-select control bus 340 has three lines which carry respectively the three digital parity-select control signals SEL<0>, SEL<1> and SEL<2>, and are connected respectively to the three parity-select control-signal input ports 318, 328, 338 of the first, second., and third stage odd/even line-selector multiplexers 310, 320, 330. The three parity-select control signals constitute a parity-select control word SEL<2:0> which encodes in a binary fashion the numbers 0 through 7 and determines the outputs of the three cascaded odd/even line-selector multiplexers 310, 320, 330.

In Table III below, the first, second and third-stage parity-select output data words S1<15:0>, S2<7:0> and S3<3:0> are set forth as a function of the state of the parity-select control word SEL<2:0>, as explained following the table.

TABLE III

| SEL<2:0> | S1<15:0> | S2<7:0> | S3<3:0> |
|---|---|---|---|
| 000 | ECO<2i> | ECO<4j> | ECO<8k> |
| 001 | ECO<2i+1> | ECO<4j+1> | ECO<8k+1> |
| 010 | ECO<2i> | ECO<4j+2> | ECO<8k+2> |
| 011 | ECO<2i+1> | ECO<4j+3> | ECO<8k+3> |
| 100 | ECO<2i> | ECO<4j> | ECO<8k+4> |
| 101 | ECO<2i+1> | ECO<4j+1> | ECO<8k+5> |
| 110 | ECO<2i> | ECO<4j+2> | ECO<8k+6> |
| 111 | ECO<2i+1> | ECO<4j+3> | ECO<8k+7> |

For the second column of Table III, the various bit positions S1<i> of the first-stage parity-select output data word S1<15:0> for a given value of the parity-select control word SEL<2:0> are provided by the entry in the column opposite the value of SEL<2:0> as the index i ranges between 0 and 15. For the third column of Table III, the various bit positions S2(j) of the second-stage parity-select output data word S2<7:0> for a given value of the parity-select control word SEL<2:0> are provided by the entry in the column opposite the given value of SEL<2:0> as the index j ranges between 0 and 7. For the third column of Table III, the various bit positions S3(k) of the third-stage parity-select output data word S3<3:0> for a given value of the parity-select control word SEL<2:0> are provided by the entry in the column opposite the given value of SEL<2:0> as the index k ranges between 0 and 3.

In addition to the odd/even line-selector multiplexers 310, 320, 330, the plane extractor 302 includes three stage-select multiplexers 350, 360, 370, which are referred to in turn as a first, a second, and a third-output-field stage-select multiplexer.

The first-output-field stage-select multiplexer 350 is a four-to-one, four-bit-wide multiplexer. Each of the four input ports of the first-output-field stage-select multiplexer 350 is connected to the four lines which carry the zero to third bit positions of one of the expand-circuit output data word ECO<31:0>, the first-stage output data word S1<15:0>, the second-stage output data word S2<7:0> and the third-stage output data word S3<3:0>, as shown in FIG. 8.

The second-output-field stage-select multiplexer 360 is a three-to-one, four-bit-wide multiplexer. Each of the three input ports of the second-output-field stage-select multiplexer 360 is connected to the four signal lines which carry the fourth to seventh bit positions of one of the expand-circuit output data word ECO<31:0>, the first-stage output data word S1<15:0> and the second-stage output data word S2<7:0>.

The third-output-field stage-select multiplexer 370 is a two-to-one, eight-bit-wide multiplexer. Each of the inputs of the third-output-field stage-select multiplexer 370 is connected to the eight lines which carry the eighth to fifteenth bit positions of one of the expand-circuit output data word ECO<31:0> and the first-stage output data word S1<15:0>, as shown in FIG. 8.

A two-line source-bit-per-pixel control bus 352 constitutes two lines of the control/timing bus 44 of the pixel depth converter 40 and is connected to the graphics controller 14. The source-bit-per-pixel control bus 352 carries a digital source-bit-per-pixel control signal SBPP<1:0> which is applied to the stage-select control-signal input ports 354, 364, 374 of the three stage-select multiplexers 350, 360, 370. In the case of the third-output-field stage-select multiplexer 370, only the lowest-order-bit control signal component SBPP<0> is applied to the stage-select control-signal input port 374 of the multiplexer 370.

The outputs of the three stage-select multiplexers are combined with the sixteen highest-order lines of the expand-circuit pixel-data output bus 36 to form a 32-line selected-plane data output bus 378. The selected-plane data output bus 378 carries a selected-plane output data word SO<31:0> which is 32 bits long. As explained in greater detail below, depending on the state of the source-bit-per-pixel control signal SBPP<1:0>, certain of the higher-order bits of the selected-plane output data word SO<31:0> may be discarded in subsequent processing of the word. The selected-plane output data word SO<31:0> as a function of the number encoded by the source-bit-per-pixel control signal SBPP<1:0> is set forth in Table IV below. In Table IV, the symbol 'X' refers to an undefined "don't-care" logic state.

TABLE IV

| SBPP<1:0> | SO<31:0> [ total ] | SO<31:0> [ portion used ] |
|---|---|---|
| 0 | ECO<31:0> | ECO<31:0> |
| 1 | ECO<31:16> \|\| S1<15:0> | . . . S1<15:0> |
| 2 | ECO<31:8> \|\| S2<7:0> | . . . S2<7:0> |
| 3 | ECO<31:16> \|\| S1<15:8> \|\| 'XXXX' \|\| S3<3:0> | . . . S3<3:0>. |

Figure 9:
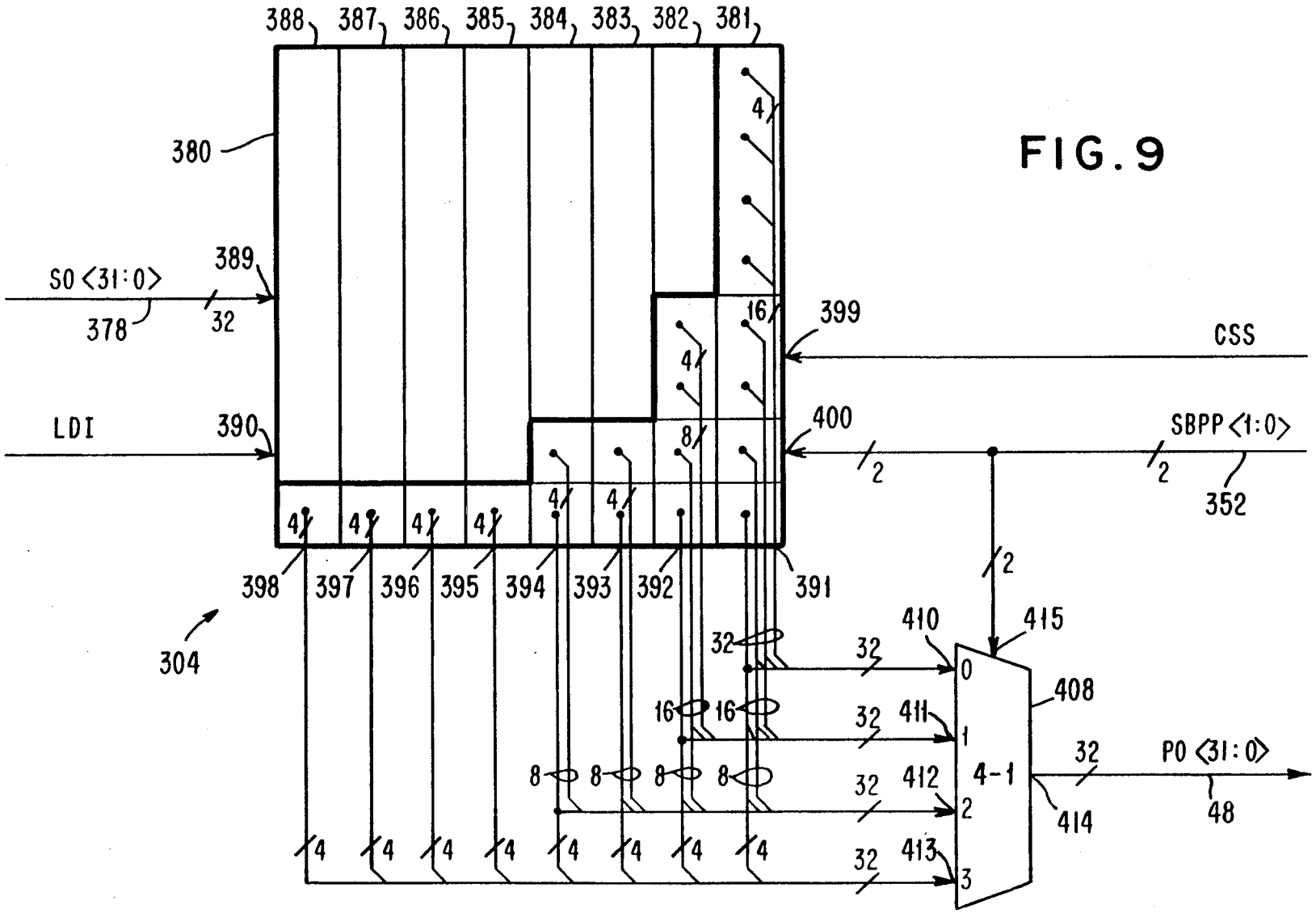
FIG. 9 is a schematic diagram of an extracted data consolidator of the plane-extract/pass-through circuit of FIG. 7.

As shown in FIG. 7, the selected-plane data output bus 378 connects an output of the plane extractor 302 to an input of the extracted data consolidator 304. Turning now to FIG. 9, the extracted data consolidator 304 includes an eight-stage, 32-bit-wide data-consolidator first-in-first-out ("FIFO") device 380 connected to a 32-bit-wide four-to-one data-consolidator multiplexer 408.

The data-consolidator FIFO device 380 has a parallel-data FIFO load input port 389 connected to the selected-plane data output bus 378. Data words 32 bits in width can be loaded in parallel into the data-consolidator FIFO device 380 through the FIFO load input port 389 in response to a load-data-in control signal—designated LDI in FIG. 9 applied to a load-data control signal input port 390 of the FIFO device 380.

The data-consolidator FIFO device 380 has eight 32-bit-wide stages 381–388 ordered from a lowest-order first FIFO stage 381 to a highest-order eighth FIFO stage 388. Each data word loaded into the FIFO load input port 389 in response to the load-data-in control signal falls through any empty higher-order FIFO stages to the lowest-order empty stage. As explained in detail below, if all or any portion of a data word is read from a lower-order stage, the entire data word in that stage is then cleared to empty that stage, and any non-cleared data words in higher-order FIFO stages fall in sequence to fill the now-empty lower stage.

The data-consolidator FIFO device 380 has a clear-selected-stages control-signal input port 399 connected to the graphics controller 14 by a single logic-signal line which carries a clear-selected-stages control signal CSS. The data-consolidator FIFO device 380 also has a source-bits-per-pixel control-signal input port 400 connected to the graphics controller 14 by the two-line source-bits-per-pixel control bus 352 which carries the source-bits-per-pixel control signal SBPP<1:0>.

Pixel data is read from the data-consolidator FIFO device 380 as consolidated 32-bit pixel-data output words PO<31:0>. To form the consolidated pixel-data output words, pixel data is read from one of four data-consolidation groups of lowest-order FIFO stages as specified by the state of the source-bits-per-pixel control signal SBPP<1:0>. The four data-consolidation groups of FIFO stages are defined as follows: (1) the first data-consolidation group, which corresponds to SBPP<1:0> equals 0, is defined to be the single lowest-order first FIFO stage 381; (2) the second data-consolidation group, which corresponds to SBPP<1:0> equals 1, is defined to be the two lowest-order first and second FIFO stages 381–382; (3) the third data-consolidation group, which corresponds to SBPP<1:0> to be the four lowest-order first through fourth FIFO stages 381–384; and (4) the fourth data-consolidation group, which corresponds to SBPP<1:0> equals 3, is defined to be all eight FIFO stages 381–388.

Each of the eight FIFO stages 381–388 of the data-consolidator FIFO device 380 has a corresponding FIFO data output port 391–398 from which data may be read. The first FIFO data output port 391 has 32 output lines which are connected to permit all 32 bit positions of the first FIFO stage 381 to be read in parallel . The second FIFO data output port 392 has sixteen output lines which are connected to permit the sixteen lowest-order bit positions of the second FIFO stage 382 to be read in parallel. The third and fourth FIFO data output ports 393 and 394 each have eight output lines which are connected to permit the eight lowest-order bit positions of the third and the fourth FIFO stages 383 and 384, respectively, to be read in parallel. Each of the fifth through the eighth FIFO data output ports 395–398 has four output lines which are connected to permit the four lowest-order bit positions of the corresponding one of the fifth through the eighth FIFO stage 385–388 to be read in parallel.

The data-consolidator multiplexer 408 has four data-consolidation input ports 410–413, a consolidated-data output port 414 and a data-consolidation-group-select control-signal input port 415. The data-consolidation-group-select control-signal input port 415 has two input lines which are connected to the source-bits-per-pixel control bus 352 to receive the source-bits-per-pixel control signal SBPP<1:0>. The four data-consolidation input ports 410–413 are referred to respectively as the first through the fourth data-consolidation input ports and can be selectively connected to the consolidated-data output port 414 as specified by an associated number encoded by the source-bits-per-pixel control signal SBPP<1:0> applied to the data-consolidation-group-select control-signal input port 415. Each of the data-consolidation input ports 410–413 of the data-consolidator multiplexer 408 has 32 input lines.

The 32 input lines of the first data-consolidation input port 410 of the data-consolidator multiplexer 408 are connected to the 32 output lines of the first FIFO data output port 391 of the data-consolidator FIFO device 380.

The 32 input lines of the second data-consolidation input port 411 of the data-consolidator multiplexer 408 are divided into a lower-order first group and an upper-order second group of sixteen contiguous lines each. The sixteen input lines of the second group are connected to the sixteen output lines of the second FIFO data output port 392 of the data-consolidator FIFO device 380. The sixteen input lines of the first group of the second data-consolidation input port 411 of the data-consolidator multiplexer 408 are connected to sixteen output lines of the first FIFO data output port 391 which are connected to the sixteen lowest order bit positions of the first FIFO stage of the data consolidator FIFO device 380.

The 32 input lines of the third data-consolidation input port 412 of the data-consolidator multiplexer 48 are divided into four groups of eight contiguous lines each. The four groups of eight lines of the third data-consolidation input port 412 are ordered in a sequence form a first, lowest-order group to a fourth, highest-order group. The eight input lines of the third and fourth groups are connected respectively to the eight output lines of the third and fourth FIFO data output ports 393, 394 of the data-consolidator FIFO device 380. The eight input lines of the first group of input lines of the third data-consolidation input port 412 of the data-consolidator multiplexer 408 are connected to eight output lines of the first FIFO data output port 391 which are connected to the eight lowest order bit positions of the first FIFO stage 381 of the data-consolidator FIFO device 380. The eight input lines of the second group of input lines of the third data-consolidation input port 412 of the data-consolidator multiplexer 408 are connected to eight output lines of the second FIFO data output port 392 which are connected to the eight lowest-order bit positions of the second FIFO stage 382 of the data-consolidator FIFO device 380.

Finally, the 32 input lines of the fourth data-consolidation input port 413 of the data-consolidator multiplexer 408 are divided into eight groups of four contiguous lines each. The eight groups of four input lines of the fourth data-consolidation input port 413 are ordered in a sequence from a first, lowest-order group to an eighth, highest-order group. The four input lines of each group are connected to four output lines of a corresponding FIFO data output port 391–398. Thus, the four input lines of the fifth through the eighth group of input lines are connected to the four output lines of the corresponding fifth through the eighth FIFO data output port 395–398 of the data consolidator FIFO device 380. The four input lines of the first group of input lines of the fourth data-consolidation input port 413 of the data-consolidator multiplexer 408 are connected to four input lines of the first FIFO data output port 391 which are connected to the four lowest-order bit positions of the first FIFO stage 381 of the data-consolidator FIFO device 380. Similarly, the four input lines of each of the second through the fourth group of input lines of the fourth data-consolidation input port 413 are connected to four output lines of the corresponding second through the fourth FIFO data output ports 392–394 which are connected to the four lowest-order bit positions of the associated FIFO stages 382–384 of the data consolidator FIFO device 380.

As noted above, the consolidated-data output port 414 of the data-consolidator multiplexer 48 is selectively connectable to one of the four data-consolidation input ports 410–413 as specified by the number encoded by the source-bits-per-pixel control signal SBPP<1:0> applied at the data-consolidation-group-select control-signal input port 415 of the multiplexer. The consolidated-data output port 414 is connected to the depth-converter pixel-data output bus 48. The depth-converter pixel-data output bus 48 carries the 32-bit-wide pixel-data output word PO<31:0> transmitted from the data-consolidator multiplexer 408. The contents of the pixel-data output word PO<31:0> as a function of the number encoded by the source-bits-per-pixel control-signal SBPP<1:0> is set forth in Table V below.

TABLE V

| SBPP<1:0> | PO<31:0> |
|---|---|
| 0 | ECO<31:0> |
| 1 | $S1^{(2)}$<15:0> \|\| $S1^{(1)}$<15:0> |
| 2 | $S2^{(4)}$<7:0> \|\| $S2^{(3)}$<7:0> \|\| $S2^{(2)}$<7:0> \|\| $S2^{(1)}$<7:0> |
| 3 | $S3^{(8)}$<3:0> \|\| $S3^{(7)}$<3:0> \|\| . . . \|\| $S3^{(2)}$<3:0> \|\| $S3^{(1)}$<3:0>. |

In Table V, the superscripts in the first, second, and third-stage parity-select output data words $S1^{(i)}$<15:0>, $S2^{(j)}$<7:0>, and $S3^{(k)}$<3:0> identify the FIFO stages of the data consolidator FIFO device 380 from which the parity-select output data words were read and thus indicate the order in which the parity-select output data words were, loaded in the FIFO device 380.

After a depth-converter pixel-data output word PO<31:0> is transmitted to the data bus 6 of the computer workstation 2 by the graphics-controller interface circuit, the graphics controller 14 transmits a clear-selected-stages signal CSS to the clear-selected-stages input port 399 of the data-consolidator FIFO device 380. The clear-selected-stages signal CSS causes the FIFO stages of the data-consolidation group specified by the source-bits-per-pixel signal SBPP<1:0> to be cleared. After the FIFO stages of a data consolidation group of stages are cleared, any data words in any higher-order FIFO stages of the data-consolidator FIFO device 380 fall in sequence to fill the cleared lower stages.

It is not intended to limit the present invention to the specific embodiments described above. It is recognized that changes may be made in the circuits and processes specifically described herein without departing from the scope and teaching of the instant invention, and it is intended to encompass all other embodiments, alternatives, and modifications consistent with the invention.

We claim:

1. A pixel-depth converter for converting source-pixel data having a source-pixel depth to destination-pixel data having a destination-pixel depth which differs from the source-pixel depth by a pixel-depth-conversion scale factor, the source-pixel depth being equal to one of a plurality of pixel depth values including at least the values one, two, and four, the destination-pixel depth being equal to one of a plurality of pixel depth values including at least the values two, four, and eight, the pixel-depth converter comprising:

(a) a packed-pixel-data depacker circuit having a packed-pixel-data parallel input port, a depacked-pixel-data parallel output port, and a depacker sequencer-control-signal input port, the: packed-pixel-data input port being data-transfer connectable to a source-pixel-data memory for receiving source-pixel data words from the memory, each source-pixel data word having a packed-pixel data format and being divisible into a plurality of depacked pixel-data word components corresponding to the pixel-depth-conversion scale factor, each depacked pixel-data word component including pixel data of the source-pixel depth for a plurality of pixels and being divisible into a plurality of depacked pixel-data-word-component subfields, a plurality of groups of terminals of the depacked-pixel-data parallel output port defining depacked-word-component output-field subports, each depacked-word-component output-field subport corresponding to a pixel-depth-conversion scale Factor, the terminals of each depacked-word-component output-field subport being divisible into a plurality of depacked-word-component-output-field-subport terminal subsets, the depacker circuit being adapted to receive a source-pixel data word at the packed-pixel-data parallel input port and, responsive to a depacker sequencer-control signal applied to the depacker sequencer-control-signal input port, transmit the data word depacked-pixel-data-word-component-by-depacked-pixel-data-word-component sequentially through the depacked-word-component output-field subport of the depacked-pixel-data output port corresponding to the pixel-depth-conversion scale factor specified by the depacker-sequencer control signal;

(b) a pixel-data-conversion-table storage circuit having a conversion-data load input port, a load-data control- signal input port, a plurality of converted-data-read parallel output ports, and a plurality of conversion-table read-address input ports, each conversion-table read-address input port being associated with a converted-data-read parallel output port, the pixel-data-conversion-table storage circuit being adapted to receive pixel-data conversion data in the conversion-data load input port and to store the pixel-data-conversion data at data-load storage locations specified by a load-data control signal applied to the load-date control-signal input port, the pixel-data-conversion-table storage circuit being adapted so that converted-pixel data from a data-read location specified by a depacked-source-pixel-data-portion conversion-lookup address applied to a conversion-table read-address input port can be read from the associated converted-data-read parallel-output port, the plurality of converted-data-read parallel output ports and associated conversion-table read-address input ports being operable effectively independently of one another so that conversion-lookup addresses may be applied independently in parallel to the plurality of conversion-table read-address input ports of the pixel-data-conversion-table storage circuit and converted-pixel data from the data-read storage locations specified by the addresses can be read in parallel from the associated converted-data-read parallel output port; and (c) a plurality of conversion-table address-selector multiplexers, each conversion-table address-selector multiplexer having a plurality of conversion-table address-selector-multiplexer depacked-source-pixel-data-portion input ports, a conversion-lookup address output port and an address-selector-multiplexer control-signal input port, corresponding depacked-source-pixel-data-portion input ports of the conversion-table address-selector multiplexers being associated with a pixel-depth-conversion scale factor, each of the depacked-source-pixel-data-portion input ports being connected to a corresponding depacked-word-component-output-field-subport terminal subset of the depacked-word-component output-field subport which corresponds to the associated pixel-depth-conversion scale factor, the conversion-lookup address output port of each of the conversion-table address selector-multiplexers being connected to an associated conversion-table read-address input port of the pixel-data-conversion-table storage circuit, and the address-selector-multiplexer control-signal input ports being connectable to a scale-factor-selection signal bus for receiving a scale-factor-selection signal which specifies the desired pixel-depth-conversion scale factor and corresponding depacked-word-component-output-field-subport terminal subsets to supply depacked-source-pixel-data-portion conversion-lookup addresses for the desired pixel data conversion.

2. The pixel-depth converter according to claim 1 in which the packed-pixel-data depacker circuit comprises:

(a.1) a data-shift multiplexer including a no-shift-primer shift-multiplexer data input port, a first-shift-increment shift-multiplexer data input port, a second-shift-increment shift-multiplexer input port, a shift-multiplexer data output port, and a shift-increment control-signal input port, each shift-multiplexer data input port having a plurality of shift-multiplexer input terminals, the shift-multiplexer output port having a plurality of shift-mutiplexer output terminals, the data-shift multiplexer being adapted to cause a selected shift-multiplexer data input port to be connected to the shift-multiplexer data output port in response to a shift-increment control signal applied to the shift-increment control-signal input port; and (a.2) a data-return register having a plurality of return-register cells, each return-register cell being of a Type-D type and having a return- register input terminal, a return- register output terminal, and a return-register-cell clock input terminal, the data-return register having a return-register clock input port connected to the return-register-cell clock input terminals so that application of a return-register clock signal to the return-register clock input port causes data present at the input terminals of the return-register cells to be loaded into the cells, each return-register input terminal being connected to a corresponding shift-multiplexer output terminal, the no-shift-primer shift-multiplexer data input port constituting the packed-pixel-data parallel input port of the packed-pixel-data depacker circuit, shift-multiplexer data input terminals of the first-shift-increment data input port being connected to return-register output terminals of the data-return register in a first-shift-increment shifted-position fashion so that in operation when the first-shift-increment shift-multilplexer data input port is connected to the shift-multiplexer data output port, at least a portion of a data word appearing at the return-register output terminals of the data-return register appears at the shift-multiplexer data output port shifted by a first shift increment, shift-multiplexer input terminals of the second-shift-increment data input port being connected to return-register output terminals of the data-return register in a second-shift-increment shifted-position fashion so that in operation when the second-shift-increment shift-multiplexer data input port is connected to the shift-multiplexer data output port, at least a portion of a data word appearing at the return-register output terminals of the data-return register appears at the shift-multiplexer data output port shifted by a second shift increment, the first shift increment differing from the second shift increment, at least a depacked-pixel-data portion of the shift-multiplexer output terminals of the shift-multiplexer data output port being connected to the depacked-pixel-data parallel output port of the packed-pixel-data depacked circuit.

3. The pixel-depth converter according to claim 2 in which the first shift increment is four and the second shift increment is eight.

4. The pixel-depth converter according to claim 3 in which shift-multiplexer input terminals of the first-shift-increment data input port are connected to return-register output terminals in a shift-right fashion so that in operation when the first-shift-increment shift-multiplexer data input port is connected to the shift-multiplexer data output port, at least a portion of a data word appearing at the return-register output terminals appears at the shift-multiplexer data output port shifted to the right, and in which shift-multiplexer input terminals of the second-shift-increment data input port are connected to return-register output terminals of the data-return register in a shift-right fashion so that in operation when the second-shift-increment shift-multiplexer data input port is connected to the shift-multiplexer data output port, at least a portion of a data word appearing at the return-register output terminals appears at the shift-multiplexer data output port shifted to the right.

5. The pixel-depth converter according to claim 1 in which the pixel-data-conversion-table storage circuit includes:

(b.1) a plurality of conversion-table registers, each conversion-table register having a plurality of register input terminals and a like plurality of register output terminals, corresponding ones of the register input terminals on the various conversion-table registers being connected in parallel to form the conversion-data load input port of the pixel-data-table storage circuit, each conversion table register having a conversion-table load-register control-signal input terminal, the conversion-table load-register control-signal input terminals of the conversion table registers collectively constituting the load-data control-signal input port of the pixel-data-conversion-table storage circuit, and the register output terminals of the conversion-table registers being grouped to define a plurality of conversion-table-entry effective-register output-terminal groupings; and (b.2) a plurality of conversion-table readout multiplexers, each conversion-table readout multiplexer having a plurality of conversion-table-multiplexer data input ports, a conversion-table-multiplexer data output port, and a conversion-table readout-multiplexer effective-register-select control input port, the conversion-table readout-multiplexer effective-register-select control input port of each conversion-table readout multiplexer constituting a conversion-table read-address input port of the pixel-data-conversion-table-storage circuit, the conversion-table multiplexer data output port of each conversion-table readout multiplexer constituting a converted-data-read parallel output port of the pixel-data-conversion-table storage circuit, corresponding ones of the conversion-table-multiplexer data input ports of the conversion-table-readout multiplexers being connected in parallel to an associated conversion-table-entry effective-register output-terminal grouping of register output terminals so that conversion-table-readout multiplexers can effectively independently read the pixel-data-conversion data appearing on the effective-register output-terminal groupings of register output terminals of the conversion table registers.

6. The pixel-depth converter according to claim 5 in which the pixel-data-conversion-table storage circuit includes four 32-bit conversion-table registers and four conversion-table readout multiplexers, each conversion-table readout multiplexer being eight-bits wide and having sixteen conversion-table-multiplexer data input ports, the 128 register output terminals of the four conversion-table registers being grouped to define sixteen conversion-table-entry effective-register output-terminal groupings of eight register output terminals each.

7. The pixel-depth converter according to claim 1 in which the pixel-data-conversion-table storage circuit includes a plurality of conversion-table random-access-memory circuits, each conversion-table random-access-memory circuit having a conversion-table RAM load-data input port, a conversion-table RAM read-data output port and a conversion-table RAM address/control input port, the conversion-table RAM load-data input ports of the conversion-table random-access-memory circuits being connected in parallel to constitute the conversion-data load input port of the pixel-data-conversion-table storage circuit, the conversion-table RAM address/control input port of each conversion-table random-access-memory circuit including load-data address/control input terminals, the load-data address/control input terminals of the conversion-table random-access-memory circuits being connected in parallel to constitute the load-data control-signal input port of the pixel-data-conversion-table storage circuit, each conversion-table RAM read-data output port constituting a converted-data-read parallel output port of the pixel-data-conversion-table storage circuit, and the conversion-table RAM address/control input port of each conversion-table random-access-memory circuit including read-data address/control input terminals which constitute a conversion-table read-address input port of the pixel-data-conversion-table storage circuit, so that the plurality of conversion-table random-access-memory circuits can be loaded in parallel with identical pixel-data-conversion data essentially simultaneously and can be read individually effectively independently of one another essentially simultaneously.

8. A pixel-depth converter for converting source-pixel data having a source-pixel depth to destination-pixel data having a destination-pixel depth which differs from the source-pixel depth by a pixel-depth-conversion scale factor, the source-pixel depth being equal to one of a plurality of pixel depth values including at least the values two, four and eight, the destination-pixel depth being equal to one of a plurality of pixel depth values including at least the values one, two and four, the pixel-depth converter comprising:

(a) a plurality of odd/even line-selector multiplexers connected in a cascaded fashion, each odd/even line-selector multiplexer being a two-to-one multiplexer having an odd/parity input port, an even-parity input port, a selected-parity output port and a parity-select control-signal input port, a first-stage odd/even line-selector multiplexer being connectable to a source-pixel-data memory by way of a source-pixel data bus for receiving source-pixel data words from the memory, input terminals of the odd-parity input port of the first-stage odd-/even line-selector multiplexer being connected respectively to alternate lines of the source-pixel data bus having odd-parity bit-position indexes, input terminal s of the even-parity input port of the first-stage odd/even line-selector multiplexer being connected respectively to alternate lines of the source-pixel data bus having even-parity bit-position indexes, input terminals of the odd-parity input port of each succeeding odd/even line- selector multiplexer after the first- stage odd/even line-selector multiplexer being connected respectively to alternate output terminals of the selected-parity output port of the immediately-preceding odd-/even line-selector multiplexer having odd-parity bit-position indexes, input terminals of the even-parity input port of each succeeding odd/even line selector multiplexer after the first-stage odd/even line-selector multiplexer being connected respectively to alternate output terminals of the selected-parity output port of the immediately preceding odd/even line-selector multiplexer having even-parity bit-position indexes, the parity-select control-signal input ports of the odd/even line-selector multiplexers constituting a plane-select control-word signal input port of the pixel-depth converter; and (b) a plurality of stage-select multiplexers, each stage-select multiplexer having a plurality of stage-select-multiplexer data input ports, a stage-select-multiplexer data output port, and a stage-select control-signal input port, input terminals of the stage-select-multiplexer data input ports of the stage-select multiplexers being connected respectively to output terminals of selected-parity output ports of the odd/even line-selector multiplexers so that, in operation, data at the output terminals of a selected-parity output of one of the odd/even line-selector multiplexers specified by a stage-select control signal applied to the stage-select control-signal input ports of the stage-select multiplexers appears at a corresponding number of output terminal s of one or more stage- select multiplexer output ports of the stage-select multiplexers.

9. A pixel-depth converter according to claim 8 further comprising:

(c) an extracted-data-consolidator circuit, the extracted-data-consolidator circuit including:

(c.1) a multi stage data-consolidator first-in-first-out device having a parallel-load FIFO data input port, a clear-selected-stages control-signal input port, a source-bits-per-pixel control-signal input port, and a plurality of FIFO read-data output ports, each FIFO read-data output port being connected to a corresponding one of the FIFO stages for reading at least a portion of data in the FIFO stage; and (c.2) a data-consolidator multiplexer having a plurality of data-consolidation input ports, a consolidated-data output port and a data-consolidation-group-select control-signal input port, each of the data-consolidation input ports being connected to consolidation output terminals of a data-consolidation grouping of one or more FIFO read-data output ports, so that in operation at least data-word portions of one or more successive data words loaded in the data-consolidator FIFO device specified by a source-bits-per-pixel control signal applied to the data-consolidation group-select control-signal input port of the data-consolidator multiplexer appear in a consolidated format at the consolidated data output of the data-consolidator multiplexer of the extracted data consolidator.

10. A pixel-depth converter for converting source-pixel data having a source-pixel depth to destination pixel data having a destination-pixel depth which differs from the source-pixel depth by a pixel-depth-conversion scale factor, the source-pixel depth being equal to one of a plurality of pixel depth values including at least the values one, two, four and eight the destination-pixel depth being equal to one of a plurality of pixel depth values including at least the values one, two, four, and eight, the pixel-depth converter comprising:

(a) a pixel-depth expansion circuit comprising:

(a.1) a packed-pixel-data depacker circuit having a packed-pixel-data parallel input port, a depacked-pixel-data parallel output port, and a depacker sequencer-control-signal input port, the packed-pixel-data input port being data-transfer connectable to a source-pixel-data memory for receiving source-pixel data words from the memory, each source-pixel data word having a packed-pixel data format and being divisible into a plurality of depacked pixel-data word components corresponding to the pixel.-depth-conversion scale factor, each depacked pixel-data word component including pixel data of the source-pixel depth for a plurality of pixels and being divisible into a plurality of depacked pixel-data-word-component subfields, a plurality of groups of terminals of the depacked-pixel-data parallel output port defining depacked-word-component output-field subports, each depacked-word-component output-field subport corresponding to a pixel-depth-conversion scale factor, the terminals of each depacked-word-component output-field subport being divisible into a plurality of depacked-word-component-output-field-subport terminal subsets, the depacker circuit being adapted to receive a source-pixel data word at the packed-pixel-data parallel input port and responsive to a depacker sequencer-control signal applied to the depacker sequencer-control-signal input port, transmit the data word depacked-pixel-data-word-component-by-depacked-pixel-data-word-component sequentially through the depacked-word-component output-field subport of the depacked-pixel-data output port corresponding to the pixel-depth-conversion scale factor specified by the depacker-sequencer control signal;

(a.2) a pixel-data-conversion-table storage circuit having a conversion-data load input port, a load-data control-signal input port, a plurality of converted-data-read parallel output ports, and a plurality of conversion-table read-address input ports, each conversion-table read-address input port being associated with a converted-data-read parallel output port, the pixel-data-conversion-table storage circuit being adapted to receive pixel-data conversion data in the conversion-data load input port and to store the pixel-data-conversion data at data-load storage locations specified by a load-data control signal applied to the load-data control-signal input port, the pixel-data-conversion-table storage circuit being adapted so that converted-pixel data from a data-read location specified by a depacked-source-pixel-data-portion conversion-lookup address applied to a conversion-table read-address input port can be read from the associated converted-data-read parallel output port, the plurality of converted-data-read parallel output ports and associated conversion-table read-address input ports being operable effectively independently of one another so that conversion-lookup addresses may be applied independently in parallel to the plurality of conversion-table read-address input ports of the pixel-data-conversion-table storage circuit and converted-pixel data from the data-read storage locations specified by the addresses can be read in parallel from the associated converted-data-read parallel output port; and (a.3) a plurality of conversion-table address-selector multiplexers, each conversion-table address-selector multiplexer having a plurality of conversion-table address-selector-multiplexer depacked-source-pixel-data-portion input ports, a conversion-lookup address output port and art address-selector-multiplexer control-signal input port, corresponding depacked-source-pixel-data-portion input ports of the conversion-table address-selector multiplexers being associated with a pixel-depth-conversion scale factor, each of the depacked- source-pixel-data-portion input ports being connected to a corresponding depacked-word-component-output-field-subport terminal subset of the depacked-word-component output-field subport which corresponds to the associated pixel-depth-conversion scale factor, the conversion-lookup address output port of each of the conversion-table address selector-multiplexers being connected to an associated conversion-table read-address input port of the pixel-data-conversion-table storage circuit, and the address-selector-multiplexer control-signal input ports being connectable to a scale-factor-selection signal bus for receiving a scale-factor-selection signal which specifies the desired pixel-depth-conversion scale factor and corresponding depacked-word-component-output-field-subport terminal subsets to supply depacked-source-pixel-data-portion conversion-lookup addresses for a desired pixel data conversion; and (b) a plane-extractor circuit comprising:

(b.1) a plurality of odd/even line-selector multiplexers connected in a cascaded fashion, each odd-/even line-selector multiplexer being a two-to-one multiplexer having an odd/parity input port, an even-parity input port, a selected-parity output port and a parity-select control-signal input port, a first-stage odd/even line- selector multiplexer being connectable to a source-pixel-data memory by way of a source-pixel data bus for receiving source-pixel data words from the memory, input terminals of the odd-parity input port of the first-stage odd/even line-selector multiplexer being connected respectively to alternate lines of the source-pixel data bus having odd-parity bit-position indexes, input terminals of the even-parity input port of the first-stage odd/even line-selector multiplexer being connected respectively to alternate lines of the source-pixel data bus having even-parity bit-position indexes, input terminals of the odd-parity input port of each succeeding odd/even line-selector multiplexer after the first-stage odd/even line-selector multiplexer being connected respectively to alternate output terminals of the selected-parity output port of the immediately-preceding odd-/even line-selector multiplexer having odd-parity bit-position indexes, input terminals of the even-parity input port of each succeeding odd/even line selector multiplexer after the first-stage odd/even line,-selector multiplexer being connected respectively to alternate output terminals of the selected-parity output port of the immediately preceding odd/even line- selector multiplexer having even-parity bit-position indexes, the parity-select control- signal input ports of the odd/even line-selector multiplexers constituting a plane-select control-word signal input port of the pixel-depth converter; and (b.2) a plurality of stage-select multiplexers, each stage-select multiplexer having a plurality of stage-select-multiplexer data input ports, a stage-select-multiplexer data output port, and a stage-select control-signal input port, input terminals of the stage-select-multiplexer data input ports of the stage-select multiplexers being connected respectively to output terminals of selected-parity output ports of the odd/even line-selector multiplexers, so that, in operation, data at the output terminals of a selected-parity output of one of the odd/even line- selector multiplexers specified by a stage-select control signal applied to the stage-select control-signal input ports of the stage-select multiplexers appears at a corresponding number of output terminals of one or more stage-select multiplexer output ports of the stage-select multiplexers.

11. The pixel-depth converter of claim 10 in which the pixel-depth expansion circuit and the plane-extractor circuit are connected in parallel.

* * * * *